US010627106B2

(12) United States Patent
Krichtafovitch et al.

(10) Patent No.: US 10,627,106 B2
(45) Date of Patent: Apr. 21, 2020

(54) COMBUSTION SYSTEM WITH A GRID SWITCHING ELECTRODE

(71) Applicant: ClearSign Combustion Corporation, Seattle, WA (US)

(72) Inventors: Igor A. Krichtafovitch, Kirkland, WA (US); Christopher A. Wiklof, Everett, WA (US)

(73) Assignee: CLEARSIGN TECHNOLOGIES CORPORATION, Seattle, WA (US)

( * ) Notice: Subject to any disclaimer, the term of this patent is extended or adjusted under 35 U.S.C. 154(b) by 162 days.

(21) Appl. No.: 16/046,165

(22) Filed: Jul. 26, 2018

(65) Prior Publication Data

US 2018/0340685 A1 Nov. 29, 2018

Related U.S. Application Data

(63) Continuation of application No. 14/654,986, filed as application No. PCT/US2013/077882 on Dec. 26, 2013, now Pat. No. 10,060,619.

(60) Provisional application No. 61/745,863, filed on Dec. 26, 2012.

(51) Int. Cl.

| | |
|---|---|
| ***F23C 99/00*** | (2006.01) |
| ***F23N 5/00*** | (2006.01) |
| ***F23N 5/12*** | (2006.01) |

(52) U.S. Cl.

CPC ..... *F23C 99/001* (2013.01); *F23N 5/00* (2013.01); *F23N 5/123* (2013.01); *F23N 2223/30* (2020.01)

(58) Field of Classification Search

CPC ... F24S 20/60; F24S 20/67; F23C 6/02; F23C 99/003; F23C 13/02; F23C 99/00; F23C 99/001; F23N 5/00

See application file for complete search history.

(56) References Cited

U.S. PATENT DOCUMENTS

| | | | |
|---|---|---|---|
| 2,604,936 | A | 7/1952 | Kaehni et al. |
| 3,004,137 | A | 10/1961 | Karlovitz |
| 3,087,472 | A | 4/1963 | Yukichi |
| 3,167,109 | A | 1/1965 | Wobig |
| 3,224,485 | A | 12/1965 | Blomgren et al. |
| 3,306,338 | A | 2/1967 | Wright et al. |
| 3,373,306 | A | 3/1968 | Karlovitz |
| 3,416,870 | A | 12/1968 | Wright |
| 3,749,545 | A | 7/1973 | Velkoff |
| 3,841,824 | A | 10/1974 | Bethel |

(Continued)

FOREIGN PATENT DOCUMENTS

| | | |
|---|---|---|
| EP | 0844434 | 5/1998 |
| EP | 1139020 | 8/2006 |

(Continued)

OTHER PUBLICATIONS

PCT International Search Report and Written Opinion of International PCT Application No. PCT/US2013/077882 dated Apr. 21, 2014.

(Continued)

*Primary Examiner* — Jason Lau

(74) *Attorney, Agent, or Firm* — Christopher A. Wiklof; Launchpad IP, Inc.

(57) ABSTRACT

A high voltage can be applied to a combustion reaction to enhance or otherwise control the combustion reaction. The high voltage is switched on or off by a grid electrode interposed between a high voltage electrode assembly and the combustion reaction.

24 Claims, 16 Drawing Sheets

(56) References Cited

U.S. PATENT DOCUMENTS

| | | | |
|---|---|---|---|
| 4,020,388 | A | 4/1977 | Pratt, Jr. |
| 4,111,636 | A | 9/1978 | Goldberg |
| 5,702,244 | A | 12/1997 | Goodson et al. |
| 5,784,889 | A | 7/1998 | Joos et al. |
| 6,193,934 | B1 | 2/2001 | Yang |
| 6,247,921 | B1 | 6/2001 | Helt |
| 6,447,637 | B1 | 9/2002 | Todorov et al. |
| 7,137,808 | B2 | 11/2006 | Branston et al. |
| 7,159,646 | B2 | 1/2007 | Dessiatoun et al. |
| 7,243,496 | B2 | 7/2007 | Pavlik et al. |
| 7,523,603 | B2 | 4/2009 | Hagen et al. |
| 8,851,882 | B2 | 10/2014 | Hartwick et al. |
| 8,911,699 | B2 | 12/2014 | Colannino et al. |
| 9,046,270 | B2 | 6/2015 | Weeks et al. |
| 9,062,882 | B2 | 6/2015 | Hangauer et al. |
| 9,243,800 | B2 | 1/2016 | Goodson et al. |
| 9,267,680 | B2 | 2/2016 | Goodson et al. |
| 9,284,886 | B2 | 3/2016 | Breidenthal et al. |
| 9,289,780 | B2 | 3/2016 | Goodson |
| 9,310,077 | B2 | 4/2016 | Breidenthal et al. |
| 9,366,427 | B2 | 6/2016 | Sonnichsen et al. |
| 9,371,994 | B2 | 6/2016 | Goodson et al. |
| 9,377,188 | B2 | 6/2016 | Ruiz et al. |
| 9,377,189 | B2 | 6/2016 | Ruiz et al. |
| 9,377,195 | B2 | 6/2016 | Goodson et al. |
| 9,427,702 | B2 | 8/2016 | Colannino et al. |
| 9,441,834 | B2 | 9/2016 | Colannino et al. |
| 9,453,640 | B2 | 9/2016 | Krichtafovitch et al. |
| 9,468,936 | B2 | 10/2016 | Goodson |
| 9,469,819 | B2 | 10/2016 | Vviklof |
| 9,494,317 | B2 | 11/2016 | Krichtafovitch et al. |
| 9,496,688 | B2 | 11/2016 | Krichtafovitch et al. |
| 2005/0208442 | A1 | 9/2005 | Heiligers et al. |
| 2005/0208446 | A1 | 9/2005 | Jayne |
| 2006/0165555 | A1 | 7/2006 | Spielman |
| 2007/0020567 | A1 | 1/2007 | Branston et al. |
| 2008/0145802 | A1 | 6/2008 | Hammer et al. |
| 2009/0314185 | A1 | 12/2009 | Whellock |
| 2010/0183424 | A1 | 7/2010 | Roy |
| 2011/0072786 | A1 | 3/2011 | Tokuda et al. |
| 2011/0203771 | A1 | 8/2011 | Goodson et al. |
| 2012/0156628 | A1 | 6/2012 | Lochschmied et al. |
| 2012/0276487 | A1 | 11/2012 | Hangauer et al. |
| 2012/0317985 | A1 | 12/2012 | Hartwick et al. |
| 2013/0071794 | A1 | 3/2013 | Colannino et al. |
| 2013/0170090 | A1 | 7/2013 | Colannino et al. |
| 2013/0230810 | A1 | 9/2013 | Goodson et al. |
| 2013/0260321 | A1 | 10/2013 | Colannino et al. |
| 2013/0291552 | A1 | 11/2013 | Smith et al. |
| 2013/0323661 | A1 | 12/2013 | Goodson et al. |
| 2013/0333279 | A1 | 12/2013 | Osler et al. |
| 2013/0336352 | A1 | 12/2013 | Colannino et al. |
| 2014/0020666 | A1 | 1/2014 | Plotnikov |
| 2014/0051030 | A1 | 2/2014 | Colannino et al. |
| 2014/0065558 | A1 | 3/2014 | Colannino et al. |
| 2014/0076212 | A1 | 3/2014 | Goodson et al. |
| 2014/0080070 | A1 | 3/2014 | Krichtafovitch et al. |
| 2014/0162195 | A1 | 6/2014 | Lee et al. |
| 2014/0162197 | A1 | 6/2014 | Krichtafovitch et al. |
| 2014/0162198 | A1 | 6/2014 | Krichtafovitch et al. |
| 2014/0170569 | A1 | 6/2014 | Anderson et al. |
| 2014/0170571 | A1 | 6/2014 | Casasanta, III et al. |
| 2014/0170575 | A1 | 6/2014 | Krichtafovitch |
| 2014/0170576 | A1 | 6/2014 | Colannino et al. |
| 2014/0170577 | A1 | 6/2014 | Colannino et al. |
| 2014/0196368 | A1 | 7/2014 | Wiklof |
| 2014/0208758 | A1 | 7/2014 | Breidenthal et al. |
| 2014/0212820 | A1 | 7/2014 | Colannino et al. |
| 2014/0216401 | A1 | 8/2014 | Colannino et al. |
| 2014/0227645 | A1 | 8/2014 | Krichtafovitch et al. |
| 2014/0227646 | A1 | 8/2014 | Krichtafovitch et al. |
| 2014/0227649 | A1 | 8/2014 | Krichtafovitch et al. |
| 2014/0248566 | A1 | 9/2014 | Krichtafovitch et al. |
| 2014/0255855 | A1 | 9/2014 | Krichtafovitch |
| 2014/0255856 | A1 | 9/2014 | Colannino et al. |
| 2014/0272731 | A1 | 9/2014 | Breidenthal et al. |
| 2014/0287368 | A1 | 9/2014 | Krichtafovitch et al. |
| 2014/0295094 | A1 | 10/2014 | Casasanta, III |
| 2014/0295360 | A1 | 10/2014 | Wiklof |
| 2014/0335460 | A1 | 11/2014 | Wiklof et al. |
| 2014/0368121 | A1 | 12/2014 | Hartwick et al. |
| 2015/0024331 | A1 | 1/2015 | Hartwick et al. |
| 2015/0079524 | A1 | 3/2015 | Colannino et al. |
| 2015/0104748 | A1 | 4/2015 | Dumas et al. |
| 2015/0107260 | A1 | 4/2015 | Colannino et al. |
| 2015/0118629 | A1 | 4/2015 | Colannino et al. |
| 2015/0121890 | A1 | 5/2015 | Colannino et al. |
| 2015/0140498 | A1 | 5/2015 | Colannino |
| 2015/0147704 | A1 | 5/2015 | Krichtafovitch et al. |
| 2015/0147705 | A1 | 5/2015 | Colannino et al. |
| 2015/0147706 | A1 | 5/2015 | Krichtafovitch et al. |
| 2015/0219333 | A1 | 8/2015 | Colannino et al. |
| 2015/0226424 | A1 | 8/2015 | Breidenthal et al. |
| 2015/0276211 | A1 | 10/2015 | Colannino et al. |
| 2015/0338089 | A1 | 11/2015 | Krichtafovitch et al. |
| 2015/0345780 | A1 | 12/2015 | Krichtafovitch |
| 2015/0345781 | A1 | 12/2015 | Krichtafovitch et al. |
| 2015/0362178 | A1 | 12/2015 | Karkow et al. |
| 2016/0018103 | A1 | 1/2016 | Karkow et al. |
| 2016/0033125 | A1 | 2/2016 | Krichtafovitch et al. |
| 2016/0040872 | A1 | 2/2016 | Colannino et al. |
| 2016/0040946 | A1 | 2/2016 | Goodson et al. |
| 2016/0091200 | A1 | 3/2016 | Colannino et al. |
| 2016/0123576 | A1 | 5/2016 | Colannino et al. |
| 2016/0138800 | A1 | 5/2016 | Anderson et al. |
| 2016/0161109 | A1 | 6/2016 | Goodson et al. |
| 2016/0161110 | A1 | 6/2016 | Krichtafovitch et al. |
| 2016/0161115 | A1 | 6/2016 | Krichtafovitch et al. |
| 2016/0215974 | A1 | 7/2016 | Wiklof |
| 2016/0245507 | A1 | 8/2016 | Goodson et al. |
| 2016/0265765 | A1 | 9/2016 | Ruiz et al. |
| 2016/0273763 | A1 | 9/2016 | Colannino et al. |
| 2016/0273764 | A1 | 9/2016 | Colannino et al. |
| 2016/0290633 | A1 | 10/2016 | Cherpeske et al. |
| 2016/0290639 | A1 | 10/2016 | Karkow et al. |
| 2016/0298836 | A1 | 10/2016 | Colannino et al. |
| 2017/0261201 | A1 | 9/2017 | Goodson et al. |
| 2017/0276346 | A1 | 9/2017 | Colannino et al. |
| 2018/0073727 | A1 | 3/2018 | Colannino |

FOREIGN PATENT DOCUMENTS

| | | |
|---|---|---|
| FR | 2577304 | 12/1989 |
| GB | 932955 | 7/1963 |
| JP | 58-019609 | 2/1983 |
| WO | WO 1996/001394 | 1/1996 |
| WO | WO 2013/181569 | 12/2013 |
| WO | WO 2015/017084 | 2/2015 |
| WO | WO 2015/089306 | 6/2018 |

OTHER PUBLICATIONS

F. Altendorfner et al., Electric Field Effects on Emissions and Flame Stability with Optimized Electric Field Geometry, The European Combustion Meeting ECM 2007, 2007, Fig. 1, Germany.

James Lawton and Felix J. Weinberg. "Electrical Aspects of Combustion." Clarendon Press, Oxford. 1969, p. 141, formula 4.131a.

Timothy J.C. Dolmansley et al., "Electrical Modification of Combustion and the Affect of Electrode Geometry on the Field Produced," Modelling and Simulation in Engineering, May 26, 2011, 1-13, vol. 2011, Himdawi Publishing Corporation.

James Lawton and Felix J. Weinberg. "Electrical Aspects of Combustion." Clarendon Press, Oxford. 1969, p. 158.

M. Zake et al., "Electric Field Control of NOx Formation in the Flame Channel Flows." Global Nest: The Int. J. May 2000, vol. 2, No. 1, pp. 99-108.

COMBUSTION SYSTEM WITH A GRID SWITCHING ELECTRODE

CROSS-REFERENCE TO RELATED APPLICATIONS

The present application is a U.S. Continuation Application of co-pending U.S. patent application Ser. No. 14/654,986, entitled "COMBUSTION SYSTEM WITH A GRID SWITCHING ELECTRODE, filed Jun. 23, 2015; which application is a U.S. National Phase Application under 35 U.S.C. § 371 of International Patent Application No. PCT/US2013/077882, entitled "COMBUSTION SYSTEM WITH A GRID SWITCHING ELECTRODE", filed Dec. 26, 2013; which application claims priority benefit from U.S. Provisional Patent Application No. 61/745,863, entitled "COMBUSTION SYSTEM WITH A GRID SWITCHED ELECTRODE", filed Dec. 26, 2012; each of which, to the extent not inconsistent with the disclosure herein, is incorporated herein by reference.

SUMMARY

It has been found that in switched or pulsed application of electric fields to a combustion reaction, desired responses of the combustion reaction can be enhanced by fast rising edges and/or falling edges of voltage waveforms applied to electrodes. Moreover, switching high voltages generally places constraints on circuit design.

According to an embodiment, a switching electrode system is configured to apply electrical energy to a combustion reaction. An electrode assembly includes a first electrode configured to carry a first voltage. A grid electrode is configured to be selectably switched to a shield voltage such as ground or to carry a passing voltage substantially the same as the first voltage or a voltage between the first voltage and ground. The grid electrode is disposed between the first electrode assembly and the combustion reaction and is configured to cause the combustion reaction to receive electrical energy from the first electrode when the grid electrode carries the passing voltage. The grid electrode is configured to shield the combustion reaction from the voltage carried by the first electrode when the grid electrode is switched to the shield voltage. The grid electrode is amenable to much faster switching and/or lower cost switching hardware compared to switching hardware for switching high voltage between a high voltage source and the first electrode. The passing voltage can be a voltage to which the grid electrode floats when the grid electrode is decoupled from the shield voltage. The shield voltage can be electrical ground.

According to an embodiment, a method for operating a combustion system includes supporting a combustion reaction with a flame holder in a combustion volume, supporting a first electrode assembly in the combustion volume, and supporting a grid electrode in the combustion volume between the first electrode assembly and the combustion reaction. A first voltage is applied to the first electrode assembly. A shield voltage is applied to the grid electrode, and the first voltage is prevented from applying electrical energy to the combustion reaction by maintaining a negligible electric field between the grid electrode and the combustion reaction. For example, if the combustion reaction is coupled to electrical ground, then the shield voltage can also be electrical ground. To apply electrical energy to the combustion reaction with the first voltage, the shield voltage is stopped being applied to the grid electrode, and the first voltage is allowed to apply electrical energy to the combustion reaction by allowing an electric field to be formed between the grid electrode and the combustion reaction. For example, stopping applying the shield voltage to the grid electrode can include allowing the grid electrode to electrically float to a voltage between the first voltage and a potential of the combustion reaction or substantially to the first voltage. In an embodiment, voltage applied to the grid electrode is switched by an insulated gate bipolar transistor (IGBT) operated by a controller. For example, the controller can include a timer configured to switch the IGBT at a selected frequency.

DETAILED DESCRIPTION

Figure 1A:
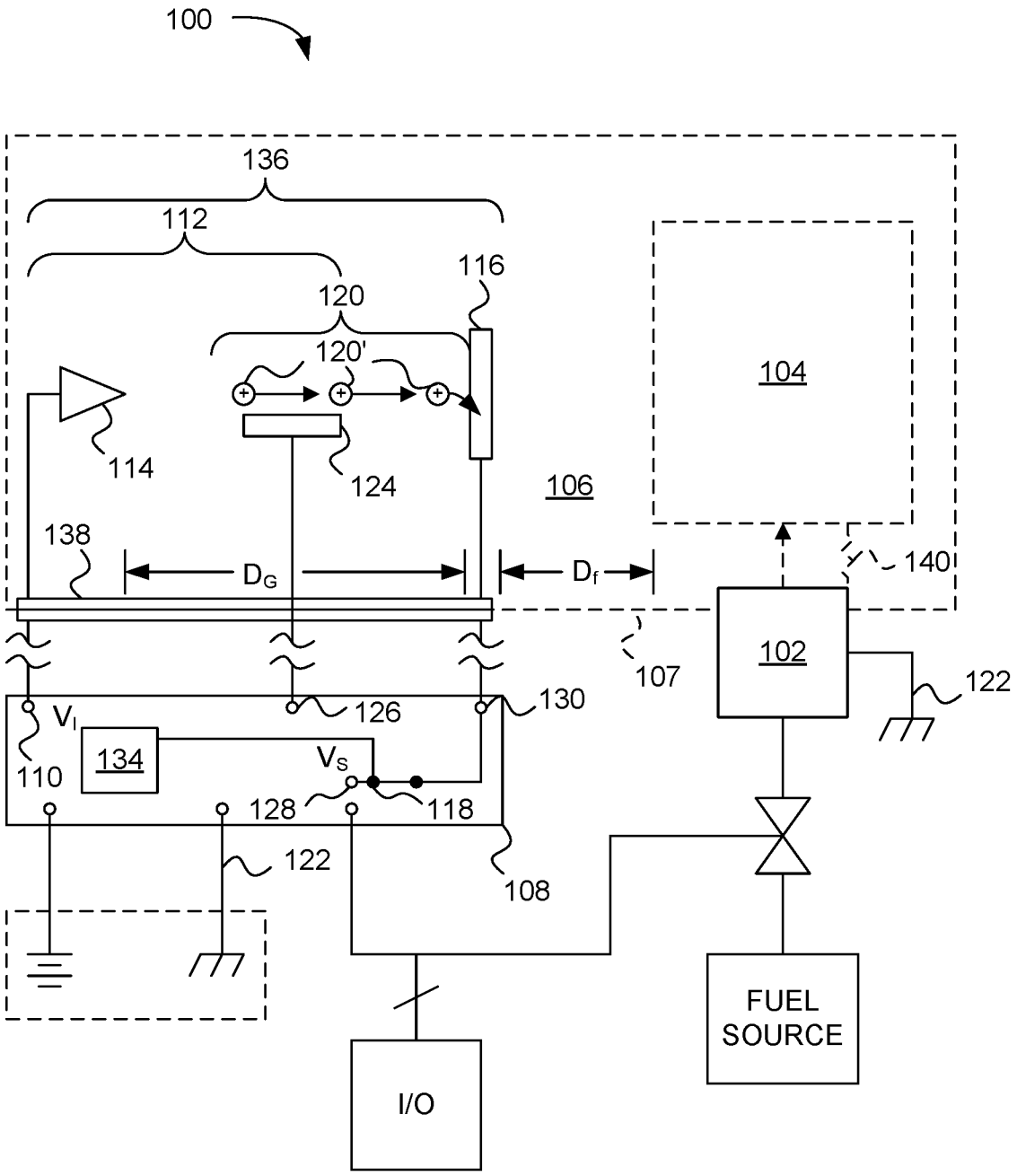
FIG. 1A is a diagram of a combustion system configured to apply electrical energy to a combustion reaction, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1A is a diagram of a combustion system 100 configured to apply electrical energy 120 to a combustion reaction 104, according to an embodiment. The combustion system 100 includes a flame holder 102 disposed in a combustion volume 106 defined at least partially by a combustion volume wall 107, and configured to hold a combustion reaction 104. A power supply 108 includes a first output node 110 configured to carry a first voltage $V_1$. A first electrode assembly 112 includes a first electrode 114 operatively coupled to the first output node 110 of the power supply 108 and configured to carry the first voltage $V_1$. A grid electrode 116 is disposed between the first electrode assembly 112 and the flame holder 102. An electrical switch 118 is operatively coupled to the grid electrode 116. The electrical switch 118 is configured to selectably couple the grid electrode 116 to a shield voltage $V_S$. The shield voltage $V_S$ is selected to prevent the combustion reaction 104 from receiving electrical energy 120 from the first electrode assembly 112.

In FIG. 1A, the electrical energy 120 is depicted as a stream of charged particles 120'. The inventors contemplate one or more other forms of the application of electrical energy 120 to the combustion reaction 104. In the depicted embodiment, 100 the first electrode 114 is configured as a corona electrode configured to emit the charged particles 120'. In a second embodiment, for example, the first electrode 114 is a field electrode configured to hold a first voltage $V_1$ to create an electric field across a portion of the combustion volume 106. In the second embodiment, coupling the grid electrode 116 to the shield voltage $V_S$ causes a first electric field between the first electrode 114 and the grid electrode 116 (corresponding to a voltage difference $V_1-V_S$ over a distance $D_G$ between the first electrode 114 and the grid electrode 116) to be formed; and a second electric field (corresponding to a voltage difference $V_S-V_f$ between the grid electrode 116 and the combustion reaction 104 over a distance $D_f$ between the grid electrode 116 and a conductive edge of the combustion reaction 104 about equal to $(V_S-V_f)/D_f$. If the shield voltage $V_S$ is selected to be substantially equal to (e.g., in continuity with) the combustion reaction voltage (e.g., a ground voltage 122), then the second electric field strength is substantially zero when the shield voltage $V_S$ is applied to the grid electrode 116, and the first electrode assembly 112 cannot apply electrical energy 120 to the combustion reaction 104.

The grid electrode 116, when coupled to the shield voltage $V_S$ by the electrical switch 118, can be configured to prevent the combustion reaction 104 from receiving electrical energy 120 from the first electrode assembly 112 by completing a circuit with the first electrode assembly 112. In other embodiments, the grid electrode 116, when coupled to the shield voltage $V_S$ by the electrical switch 118, can be configured to prevent the combustion reaction 104 from receiving electrical energy 120 from the first electrode assembly 112 by establishing a substantially zero electric field with the combustion reaction 104 or the flame holder 102.

Additionally or alternatively, the grid electrode 116, when coupled to the shield voltage $V_S$ by the electrical switch 118, is configured to prevent the combustion reaction 104 from receiving electrical energy 120 from the first electrode assembly 112 by establishing an electrical potential difference with the first electrode assembly 112 substantially equal to an electrical potential difference between the first electrode assembly 112 and the combustion reaction 104 or the flame holder 102.

Referring to FIG. 1A, the shield voltage $V_S$ can be different than the first voltage $V_1$. The shield voltage $V_S$ can be voltage ground.

The first voltage $V_1$ can be greater than or equal to 1000 V magnitude. In another embodiment, the first voltage $V_1$ is about 10,000 volts or more. In another embodiment, the first voltage $V_1$ can be about 20,000 volts or more.

The first electrode assembly 112 can include the first electrode 114 and a counter electrode 124 operatively coupled to respective first 110 and second 126 nodes of the power supply 108. The power supply 108 can be configured to output respective voltages $V_1$, $V_S$ on the first and second nodes 110, 126 selected to cause an ionic wind 120 to stream from the first electrode 114 toward the grid electrode 116.

In another embodiment, the first electrode assembly 112 can include the first electrode 114 and a counter electrode 124. The first electrode 114 can be a corona electrode. The power supply 108 can be configured to output a voltage on the first node 110 operatively coupled to the first electrode 114 at or above a corona inception voltage.

Peek's Law predicts the corona inception voltage as a function of physical properties, geometry of the corona electrode, and geometry of the counter electrode 124.

Peek's law can be described by the formula:

$$e_v = m_v g_v \partial r \ \ln\left(\frac{S}{r}\right).$$

The symbol $e_v$ in Peek's law can represent the "corona inception voltage" (CIV), the voltage difference (in kilovolts) that can initiate a (sometimes visible) corona discharge at the electrodes. The values for $e_v$ and gain can be inversely related, e.g., as $e_v$ decreases, gain can increase and as $e_v$ increases, gain can decrease.

The symbols $m_v$ and r in Peek's law can collectively represent a variety of factors relating to the shape and surface geometry of the electrodes. The symbol $m_v$ can represent an empirical, unit-less irregularity factor that can account for surface roughness of the electrodes. For example, for smooth, polished electrodes, $m_v$ can be 1. For roughened, dirty or weathered electrode surfaces, $m_v$ can be 0.98 to 0.93, and for cables, $m_v$ can be 0.87 to 0.83. For wire electrodes, or electrodes ending in a curved tip, r can represent the radius of the wires or a radius of the curved tip.

The symbol S in Peek's law can represent the distance between the electrodes, for example, the distance between the one or more electrodes and a conductive plasma of the combustion reaction and/or the burner or fuel source, if grounded.

The symbol δ in Peek's law can represent factors relating to air density, pressure, and temperature where b is pressure in centimeters of mercury, and T is temperature in Kelvin. At standard temperature and pressure, δ can be 1:

$$\partial = \frac{3.92b}{T}$$

The symbol $g_v$ in Peek's law can represent a "visual critical" potential gradient, where $g_0$ can represent a "disruptive critical" potential gradient, about 30 kV/cm for air:

$$g_v = g_0\partial\left(1 + \frac{0.301}{\sqrt{\partial r}}\right)$$

The electrode gain value can be inversely related to $m_v$, for example, rougher electrodes can lead to higher electrode gain values. While from Peek's law the relationship with r can be less clear than for $m_v$, experimental work has shown that sharper electrodes can lead to higher electrode gain values.

The electrode gain value can be inversely related to b, for example, lower pressures can lead to higher electrode gain values. The electrode gain value can be related to T, for example, higher temperatures can lead to higher electrode gain values. The electrode gain value can be inversely related to δ, for example, lower δ can lead to higher electrode gain values. The electrode gain value can be inversely related to S, for example, reducing the distance between the one or more electrodes and a conductive plasma of the combustion reaction and/or the burner or combustion fluid source, if grounded, can lead to higher electrode gain values. The electrode gain value can be determined at least in part by one or more of: a distance between the one or more electrodes and a center of the combustion volume; a temperature at the one or more electrodes; a pressure at the one or more electrodes; and/or a surface geometry of the one or more electrodes.

Figure 1B:
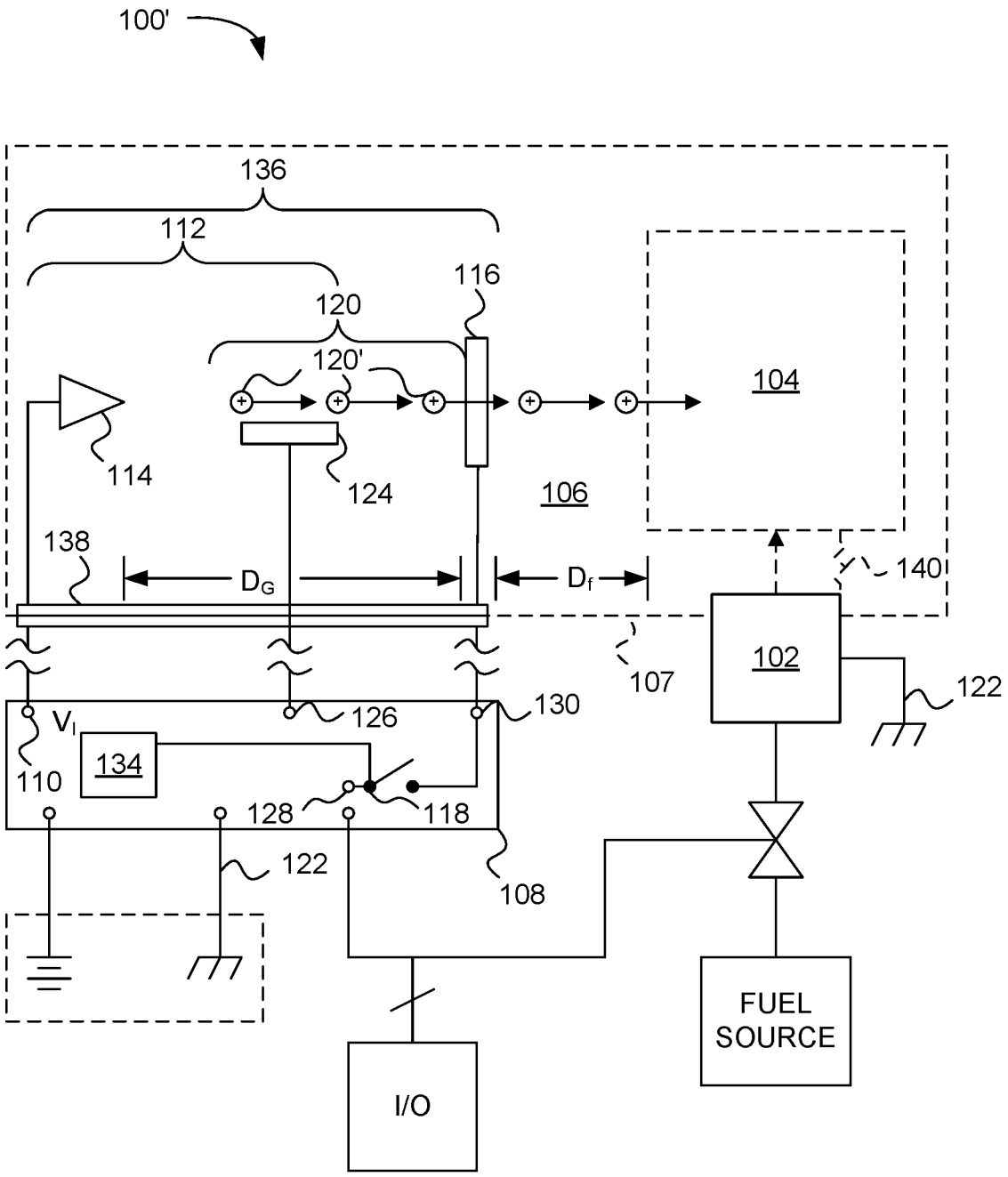
FIG. 1B is a diagram showing a configuration of the combustion system configured to apply electrical energy to a combustion reaction, according to an embodiment.

FIG. 1B is a diagram showing a configuration 100' of the combustion system 100 configured to apply electrical energy 120 to a combustion reaction, according to an embodiment. Referring to FIG. 1B, the electrical switch 118 can be further configured to selectively decouple the grid electrode 116 from the shield voltage $V_S$.

Figure 1C:
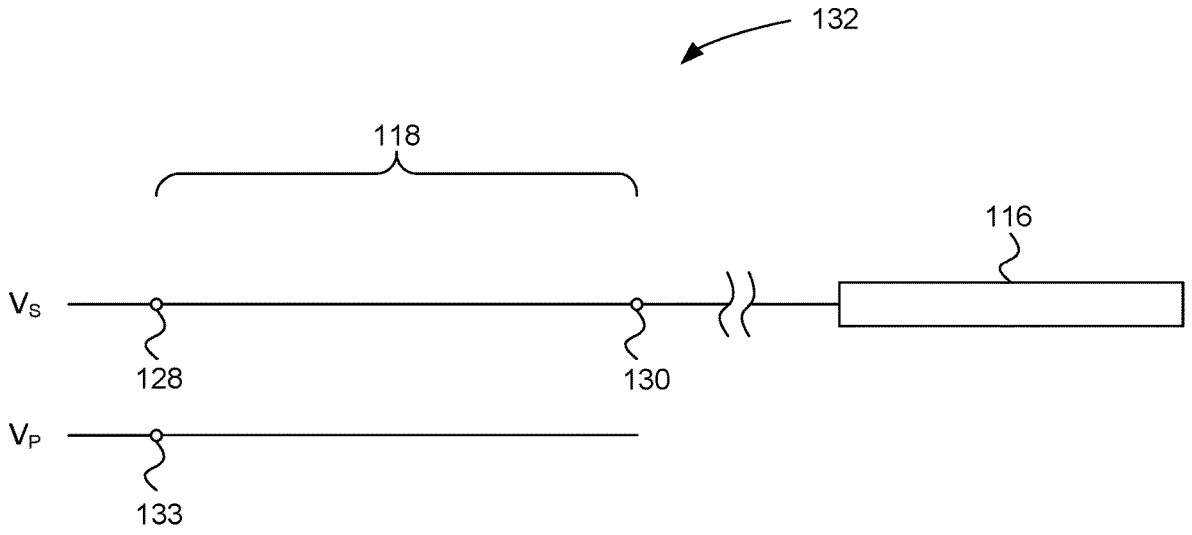
FIG. 1C illustrates a configuration of the electrical switch connected to transmit a shield voltage $V_S$ to the grid electrode, according to an embodiment.
Figure 1D:
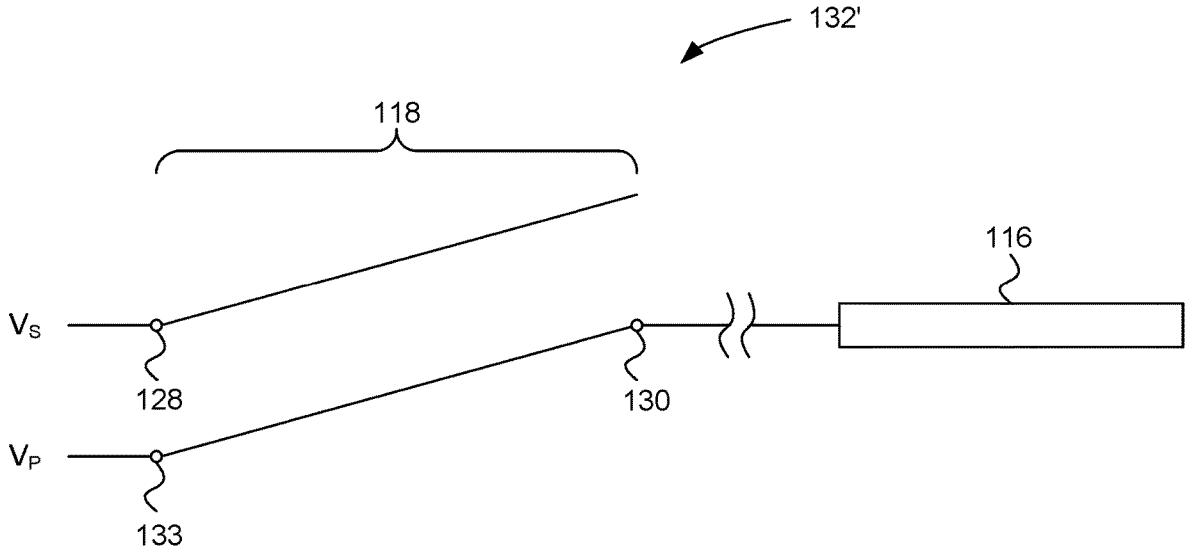
FIG. 1D illustrates a configuration of the electrical switch connected to transmit a passing voltage $V_P$ from a passing voltage node to the grid electrode, according to an embodiment.

While FIG. 1B illustrates the switch 118 as decoupling the grid electrode 116 from a shield voltage node 128, the system 100, 100' can alternatively be configured to output an passing voltage $V_P$ on a node 130 of the power supply 108 operatively coupled to the grid electrode 116. FIG. 1C illustrates a configuration 132 of the electrical switch 118 embodied as a double-pole double throw (DPDT) switch connected to transmit the shield voltage $V_S$ to the grid electrode 116 via a power supply node 130. The switch 132 can alternatively be embodied as a single-pole double-throw (SPDT) switch. FIG. 1D illustrates a configuration 132' of the DPDT electrical switch 118 connected to transmit a passing voltage $V_P$ from a passing voltage node 133 through the power supply node 130 to the grid electrode 116. In other words the power supply 108 can be configured to drive a grid electrode electrical node 130 to cause the first electrode assembly 112 to raise the grid electrode 116 to a passing electrical potential substantially equal to a local voltage $V_P$ corresponding to an electric field formed between the first electrode assembly 112 and the combustion reaction 104 when the grid electrode 116 is decoupled from the shield voltage $V_S$.

Alternatively, the grid electrode 116 can be allowed to electrically float to cause the grid electrode 116 to adopt a local voltage intermediate to the first voltage $V_1$ and the ground voltage 122 carried by the combustion reaction 104, as depicted in the diagram of the embodiment 100' shown in FIG. 1B. The grid electrode 116 can be configured to electrically float when the grid electrode 116 is decoupled from the shield voltage $V_S$.

The electrical switch 118 can be further configured to selectively decouple the grid electrode 116 from the shield voltage $V_S$ and couple the grid electrode 116 to a passing voltage node 133 of the power supply 108 configured to carry a passing voltage $V_P$ selected to allow the first electrode assembly 112 to apply electrical energy 120 to the combustion reaction 104.

In still other embodiments, the power supply 108 can be configured to output a variable passing voltage $V_P$ on the passing voltage node 133, the variable passing voltage $V_P$ being selected to cause the first electrode assembly 112 to apply electrical energy 120 to the combustion reaction 104 proportional to the variable passing voltage $V_P$.

The electrical switch 118 can include a mechanical switch, an optical switch, a magnetic switch and/or a transistor cascade. The electrical switch 118 can include an insulated gate bipolar transistor (IGBT). Additionally or alternatively, the electrical switch 118 can be part of the power supply 108.

The combustion system 100 can include a controller 134 configured to control the electrical switch 118. The controller 134 can be part of the power supply 108. Additionally or alternatively, the controller 134 can be separate from the power supply 108.

The controller 134 can be configured to control the electrical switch 118 to cause the first electrode assembly 112 to apply electrical energy 120 to the combustion reaction 104 corresponding to an electric field waveform having fast rising edges and/or having fast falling edges The controller 134 can be configured to control the electrical switch 118 to cause the first electrode assembly 112 to apply electrical charges to the combustion reaction 104 according to a waveform having fast rising edges and/or corresponding to a waveform having fast falling edges.

Figure 2:
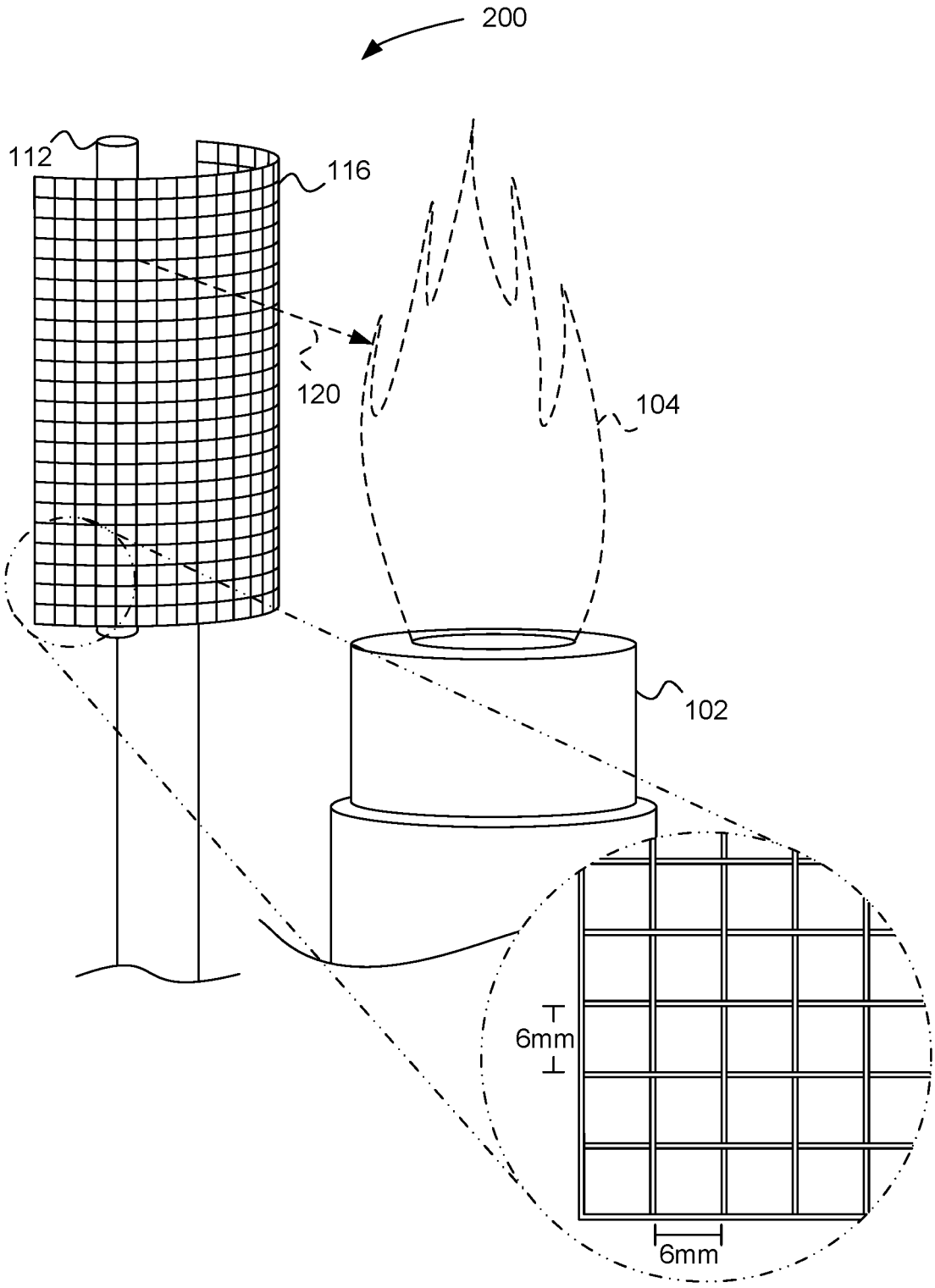
FIG. 2 is a diagram of a combustion system including a first electrode assembly and a grid electrode, according to an embodiment.

FIG. 2 is a diagram of a combustion system 200 including a first electrode assembly 112 and a grid electrode 116, according to an embodiment. The grid electrode 116 can be formed as a cylindrical surface having sufficient size to substantially occlude the combustion reaction 104 from field effects or charge produced by the first electrode assembly 112.

Grid electrode 116 shapes other than cylindrical can alternatively be used. For example, the grid electrode 116 can be a planar circle or polygon. The edges of the grid electrode 116 can be joined to form a continuous or encircling electrode, or the edges can be truncated such that an indirect "grid-free" path between the first electrode assembly 112 and the combustion reaction 104 exists. The use of an emitter first electrode and counter electrode pair as the first electrode assembly 112 can substantially confine electrical energy 120 consisting essentially of a stream of charged particles to a relatively narrow cone such that substantially the entire cone intersects the grid electrode 116 for collection or passing.

The grid electrode 116 can include a metal screen having a mesh size of about 6 millimeters square. For example, the grid electrode 116 can be formed from stainless steel hardware cloth.

Figure 3:
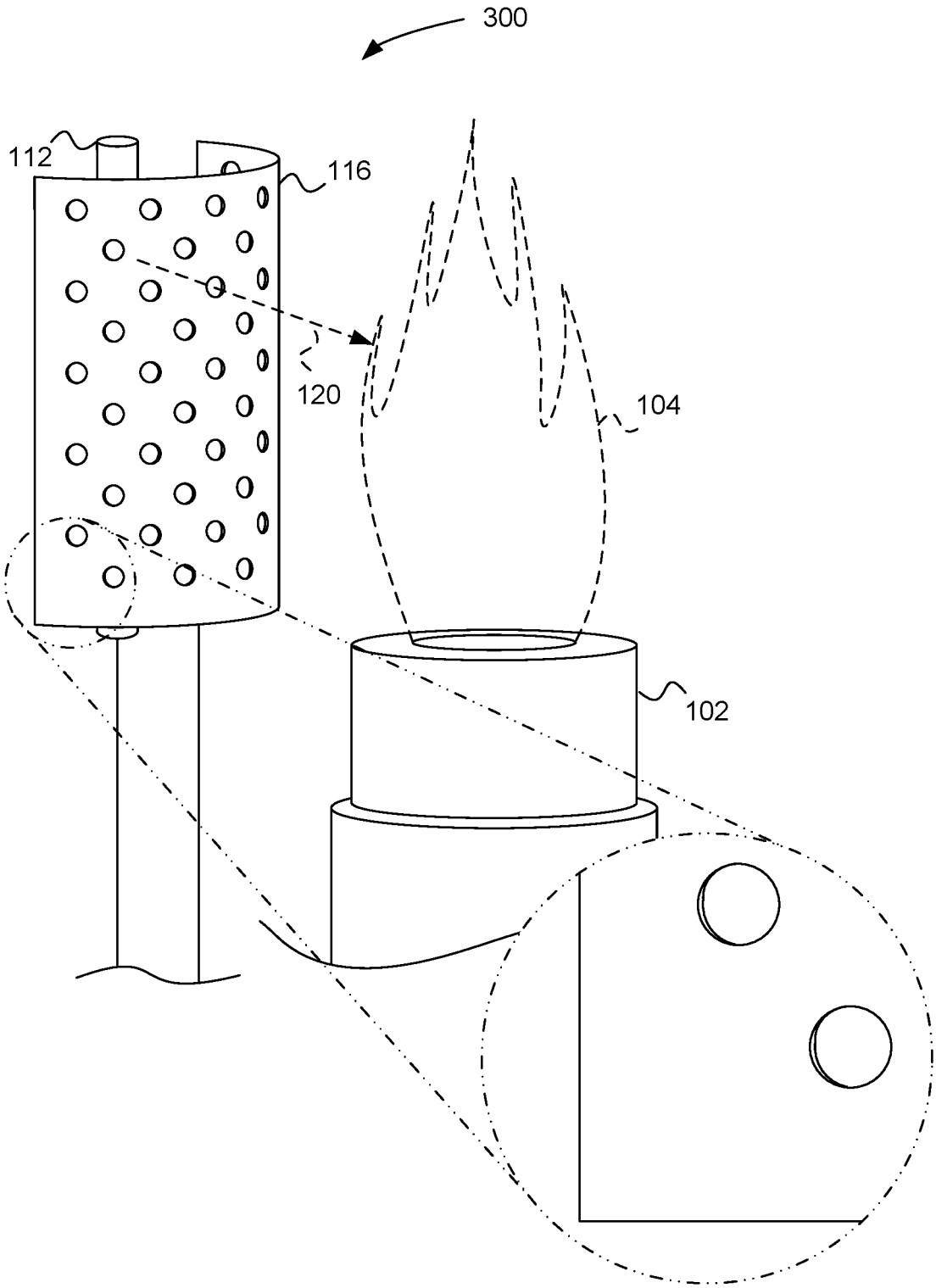
FIG. 3 is a diagram of a combustion system including a first electrode assembly and a grid electrode, according to another embodiment.

FIG. 3 is a diagram 300 of the grid electrode 116 including drilled sheet metal, according to an embodiment. The grid electrode 116 can include punched sheet metal.

Figure 4:
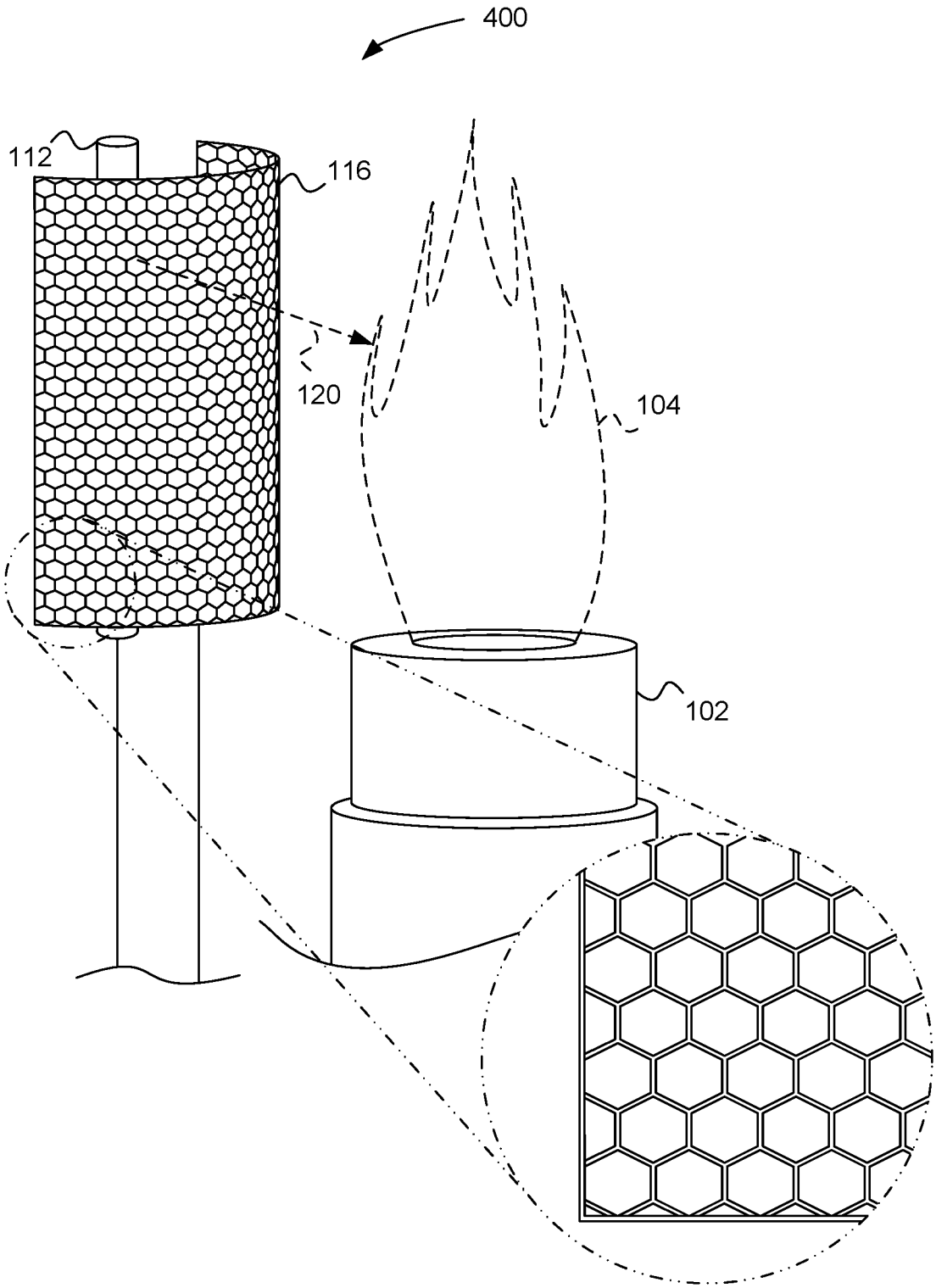
FIG. 4 is a diagram of a combustion system including a first electrode assembly and a grid electrode, according to another embodiment.

FIG. 4 is a diagram 400 of the grid electrode 116 including expanded metal, according to an embodiment. The grid electrode 116 can include a metal mesh and/or a perforated metal.

Figure 5:
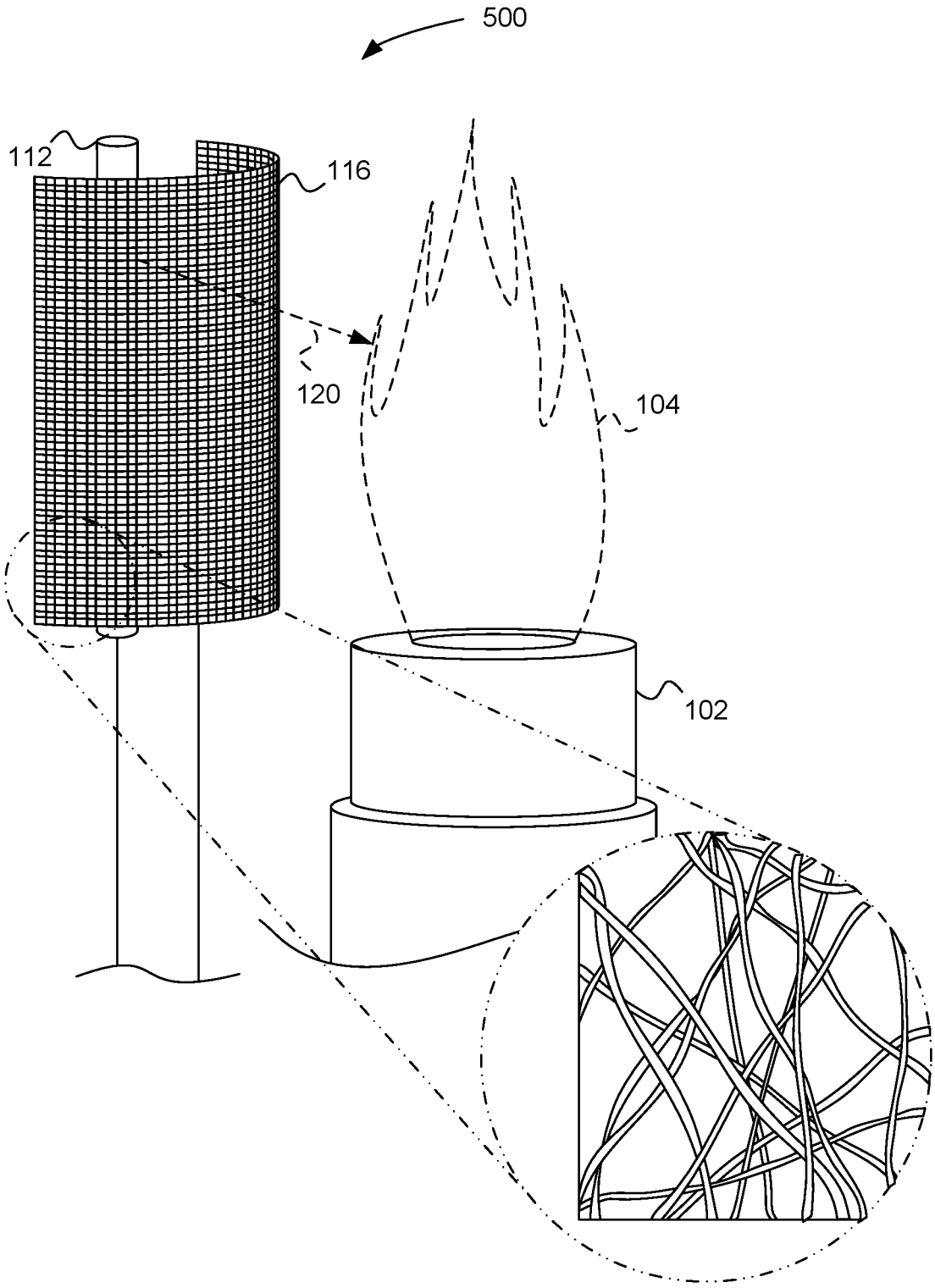
FIG. 5 is a diagram of a combustion system including a first electrode assembly and a grid electrode, according to another embodiment.

FIG. 5 is a diagram 500 of the grid electrode 116 including nonwoven metal strands having a high void factor, according to an embodiment.

Figure 6:
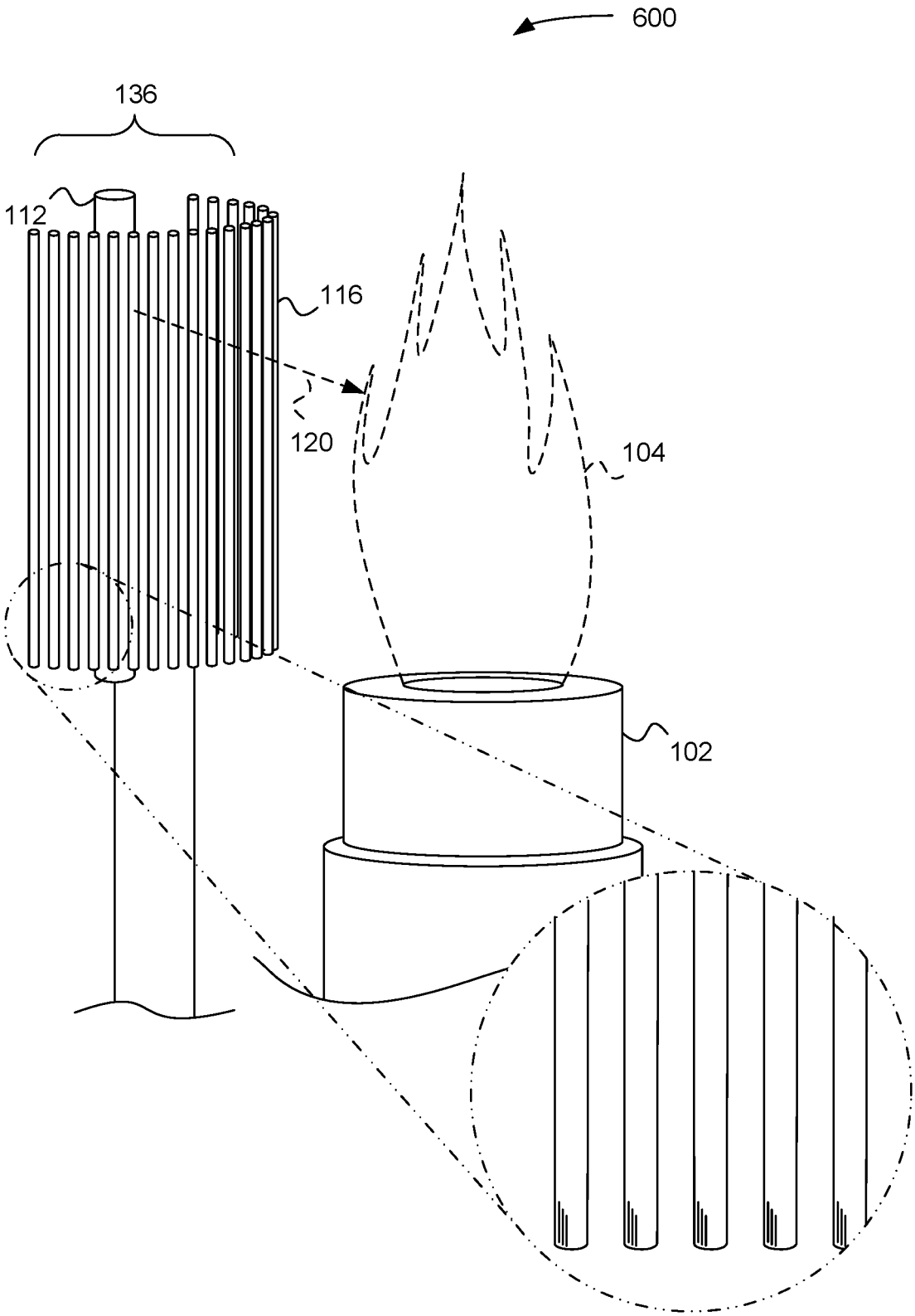
FIG. 6 is a diagram of a combustion system including a first electrode assembly and a grid electrode, according to another embodiment.

FIG. 6 is a diagram of 600 the grid electrode 116 including parallel cylinders, according to an embodiment.

Taken together, the first electrode assembly 112 (which can be formed from a first electrode 114 and a counter electrode 124) and the grid electrode 116 can form a grid-controlled electrode assembly 136. The grid-controlled electrode assembly 136 can be formed as a module configured to be installed and uninstalled from the combustion system 100 as a unit. In an embodiment, the grid-controlled electrode assembly 136 can to be configured to be inserted through an aperture in a combustion volume wall 107 and can include a fitting 138 configured operatively couple the grid-controlled electrode assembly 136 to the combustion volume wall 107 from outside the combustion volume 106. This arrangement can, for example, allow the grid-controlled electrode assembly 136 to be replaced with minimum or no system downtime.

Figure 7A:
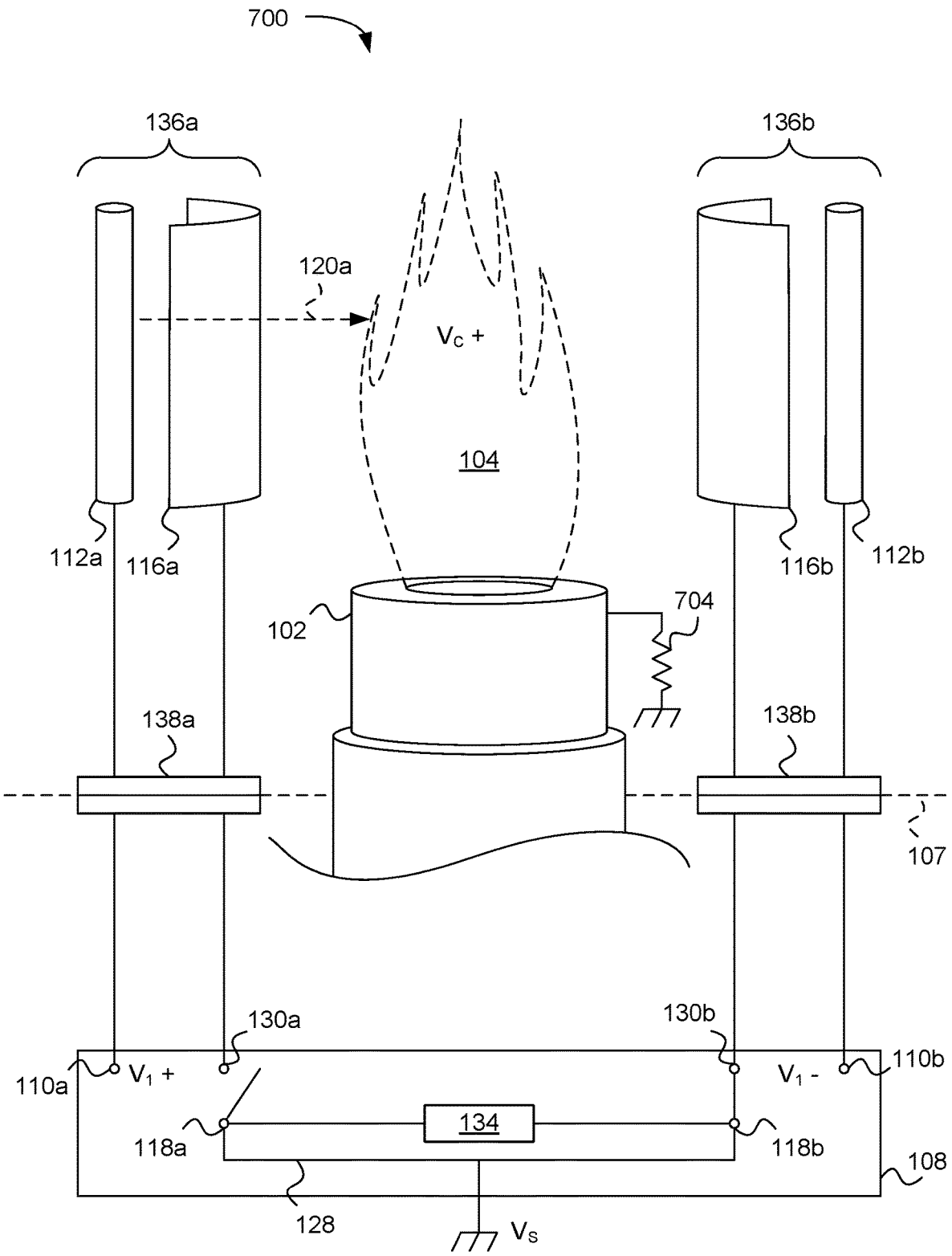
FIG. 7A is a diagram of a combustion system configured to apply alternating polarity electrical energy to a combustion reaction, according to an embodiment.
Figure 7B:
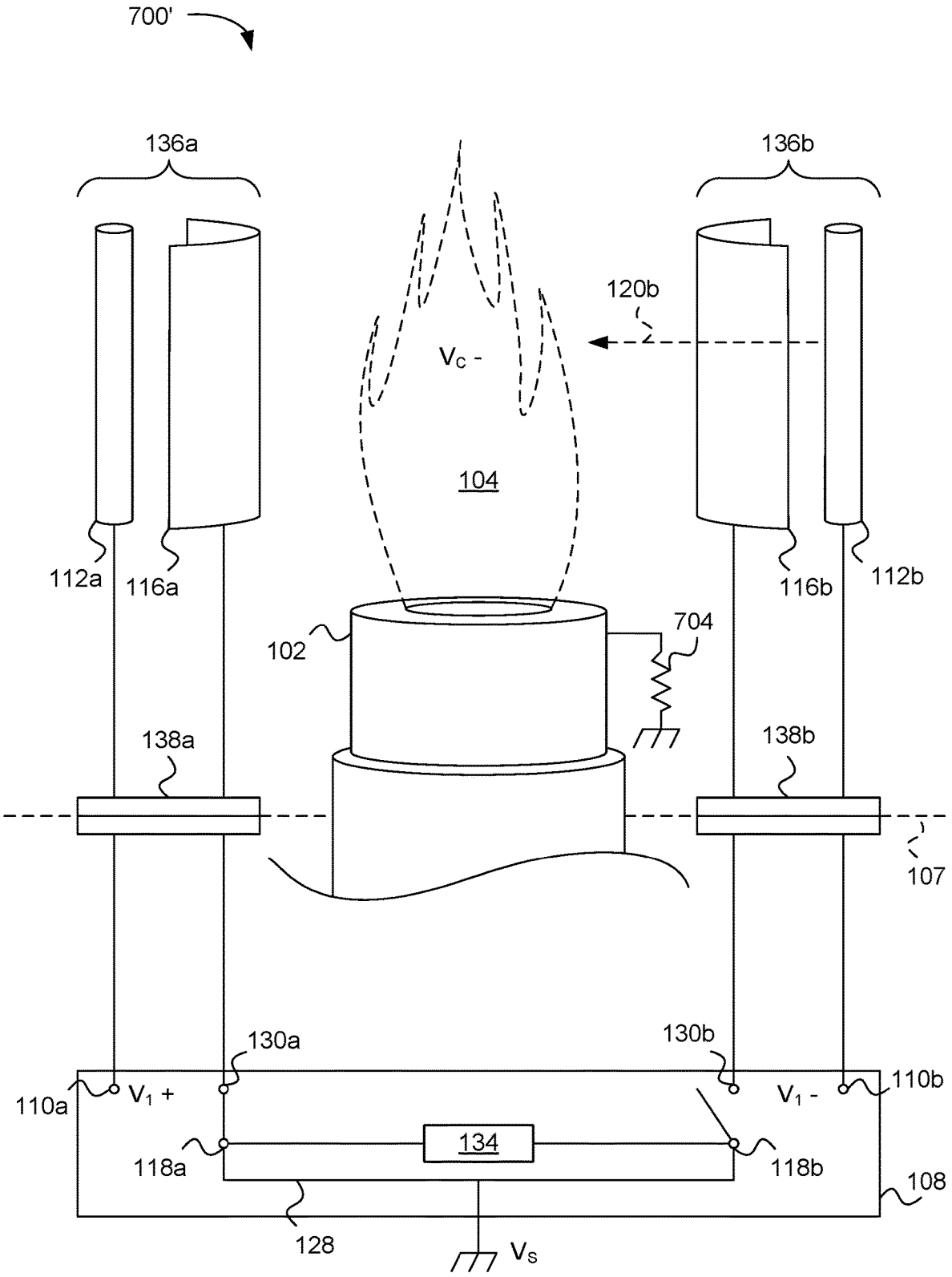
FIG. 7B is a diagram of a combustion system configured to apply alternating polarity electrical energy to a combustion reaction, according to an embodiment.

FIG. 7A, 7B is a diagram of a combustion system 700, 700' configured to apply alternating polarity electrical energy 120*a*, 120*b* to a combustion reaction 104, according to an embodiment. The combustion system 700, 700' includes a flame holder 102 configured to support a combustion reaction 104. A first grid-controlled electrode assembly 136*a* is configured to selectively apply electrical energy 120 to a combustion reaction 104 from a positive voltage $V_1$+. A second grid-controlled electrode assembly 136*b* is configured to selectively apply electrical energy 120 to the combustion reaction 104 from a negative voltage $V_1$−.

The combustion system 700, 700' can further include a first electrical switch 118*a* configured to selectively couple a first grid electrode 116*a* of the first grid-controlled electrode assembly 136*a* to a shield voltage $V_S$ and a second electrical switch 118*b* configured to selectively couple a first grid electrode 116*a* of the first grid-controlled electrode assembly 136*a* to a shield voltage $V_S$.

The flame holder 102 can be insulated from voltage ground through a high electrical resistance 704. The high electrical resistance 704 can include a resistor. The high electrical resistance 704 can include resistance through an electrical insulator. The high electrical resistance 704 can be inherent in a high resistivity material from which the flame holder 102 is formed. Referring to FIG. 1, the combustion reaction can be isolated from a voltage carried b the fuel nozzle through a resistance 140.

The first and second grid-controlled electrode assemblies 136*a*, 136*b* can be configured to alternately charge the combustion reaction 104 to carry a positive voltage $V_C$+ and a negative voltage $V_C$−.

The switch 118 was found to switch the grid electrodes 116*a*, 116*b* between $V_S$ and a passing voltage $V_P$ in a few (single digit) microseconds when configured as shown in FIGS. 1A and 1B. Allowing for electrical energy propagation 120*a*, 120*b* delay, the inventors believe the arrangement 700, 700' is capable of producing a square wave bipolar voltage waveform in the combustion reaction 104 at 1000 Hz or higher frequency. Previous work by the inventors showed that waveform frequencies between about 50 Hz and 1000 Hz produce significant effects on a combustion reaction 104. Moreover, sharp waveform edges, such as those produced by the apparatus 100, 100', 700, 700' were found to amplify the significant effects because sharper waveform edges produced more pronounced effects. The effects produced by the application of periodic voltage waveform to the combustion reaction 104 include enhanced flammability, enhanced flame stability, higher flame emissivity, increased heat transfer, decreased heat transfer, and reduced soot output from the combustion reaction 104, depending on the arrangement and/or existence of other electrodes proximate to the combustion reaction 104 and electric fields produced thereby.

With respect to applied voltage, the inventors hypothesize that the application of a stream of charged particles 120' to the combustion reaction 104 under acceleration by a counter electrode 124 will operate in a manner akin to a Van de Graff generator, and should be able to charge the combustion reaction 104 to a voltage $V_C$+, $V_C$− higher in magnitude than the voltage $V_1$+, $V_1$− applied to the first electrode assemblies 112*a*, 112*b*. To date, the inventors have achieved a measurable voltage in a combustion reaction 104 of +6000 volts using a +40 KV first voltage $V_1$ applied to a first electrode 114 configured as a corona electrode. The inventors believe further optimization to the grid electrode geometry, counter electrode geometry and material, burner insulation, and voltage probe impedance will likely increase combustion reaction voltage $V_C$+, $V_C$− relative to the first voltage $V_1$+, $V_1$−.

The combustion system 700, 700' can include a controller 134 configured to drive the electrical switches 118*a*, 118*b*. The controller 134 can include a timer circuit. The controller 134 can drive the electrical switches 118*a*, 118*b* to an opposite state twice at a frequency of between 50 Hz and 1000 Hz.

The combustion system 700, 700' can further include modular connectors 138*a*, 138*b* respectively configured to couple the grid-controlled electrode assemblies 136*a*, 136*b* to a combustion volume wall 107.

According to an embodiment, shield voltage $V_S$ can be a ground voltage 122.

The first and second voltages $V_1$+, $V_1$− can be respectively+10 KV and −10 KV or greater.

The electrical switches 118*a*, 118*b* can include insulated gate bipolar transistors (IGBTs). The two electrical switches 118*a*, 118*b* can be configured as two single pole single throw (SPST) switches. The two electrical switches 118*a*, 118*b* can be arranged as one single pole double throw (SPDT) switch.

Figure 8:
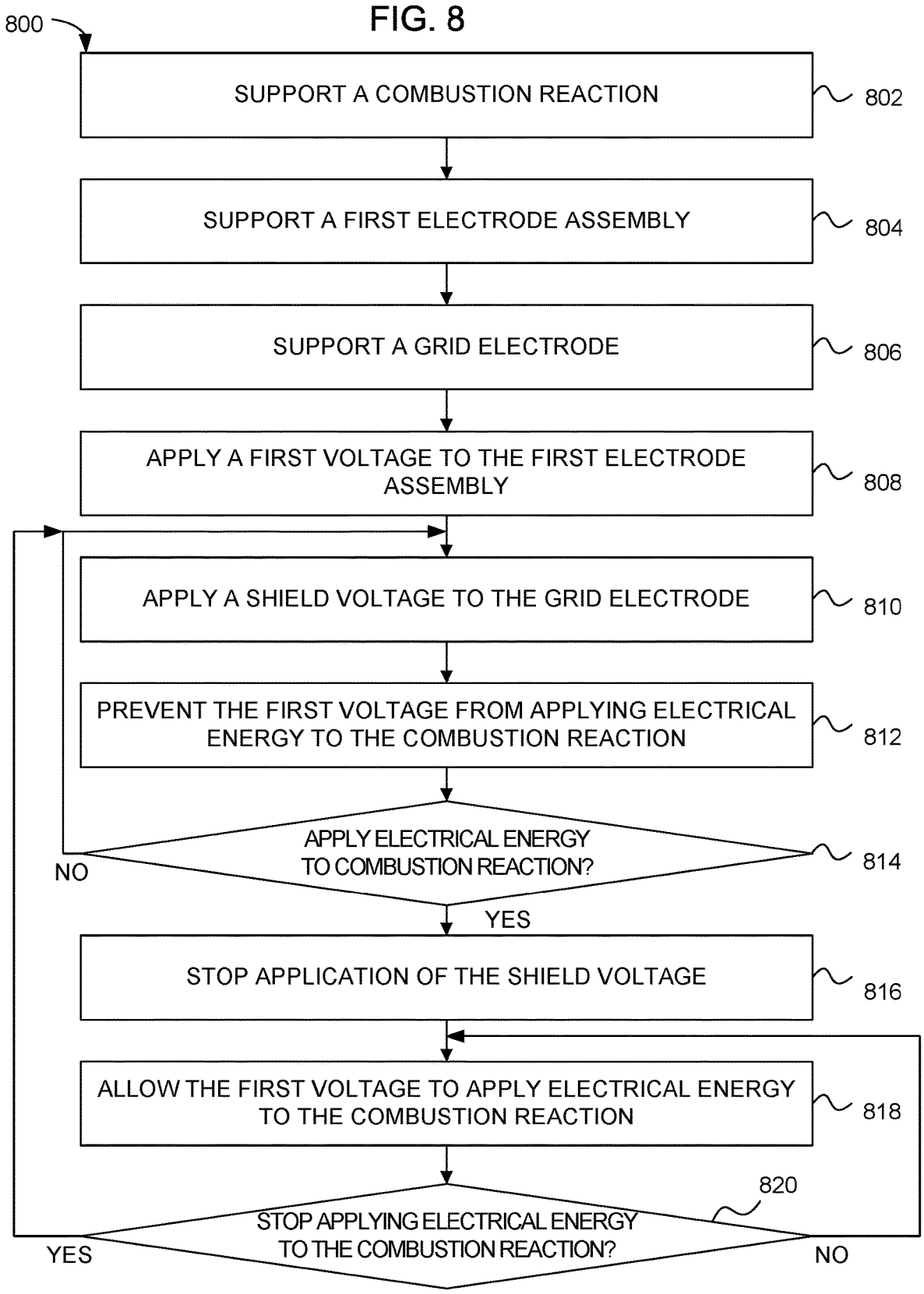
FIG. 8 is a flow chart of a method for operating a combustion system, according to an embodiment.

FIG. 8 is a flow chart of a method 800 for operating a combustion system, according to an embodiment. The method 800 includes step 802 a combustion reaction is supported with a flame holder in a combustion volume. In step 804 a first electrode assembly is supported in the combustion volume. Continuing to step 806, a grid electrode is supported in the combustion volume between the first electrode assembly and the combustion reaction. In step 808 a first voltage is applied to the first electrode assembly. Proceeding to step 810 a shield voltage is applied to the grid electrode. In step 812 the first voltage is prevented from applying electrical energy to the combustion reaction by maintaining a negligible electric field between the grid electrode and the combustion reaction.

In a decision step 814, a determination is made about whether electrical energy is selected to be applied to the combustion reaction by the first voltage. If electrical energy is not selected to be applied, the method 800 loops back to step 810. If electrical energy is selected to be applied to the combustion reaction by the first voltage, the method proceeds to step 816.

The method 800 further includes step 816 application of the shield voltage to the grid electrode is stopped. In step 818 the first voltage is allowed to apply electrical energy to the combustion reaction by allowing an electric field to be formed between the grid electrode and the combustion reaction.

In step 816, stopping application of the shield voltage to the grid electrode can include applying a passing voltage to the grid electrode, the passing voltage being selected to form the electric field between the grid electrode and the combustion reaction. Step 816 can include allowing the grid electrode to electrically float to a passing voltage that allows the first voltage to form an electric field with the combustion reaction.

In a decision step 820, a determination is made about whether electrical energy is selected to stop being applied to the combustion reaction by the first voltage. If electrical energy is selected to continue being applied, the method 800 loops back to step 818. If electrical energy is selected to stop being applied to the combustion reaction by the first voltage, the method loops back to step 810.

Supporting a first electrode assembly in the combustion volume can include supporting a first electrode configured to output a corona discharge and supporting a counter electrode configured to accelerate charged particles formed by the corona discharge toward the grid electrode and the combustion reaction.

In step 804 supporting a first electrode assembly in the combustion volume and supporting a grid electrode in the combustion volume can include supporting a grid-controlled electrode assembly including the first electrode assembly and the grid electrode. Step 804 can include supporting a grid-controlled electrode assembly in the combustion volume with a modular coupling configured to allow replacing the grid-controlled electrode assembly as a unit from outside the combustion volume.

In step 808 applying a first voltage to the first electrode assembly can include applying a first voltage at or above a corona inception voltage to a corona electrode. Step 808 can further include applying an acceleration voltage to a counter electrode to accelerate a corona discharge formed by the corona electrode.

Step 808 can include applying a first voltage to a field electrode.

The method 800 can further include switching between applying the shield voltage to the grid electrode and not applying the shield voltage to the grid electrode at a frequency between 50 Hz and 1000 Hz, for example.

Figure 9:
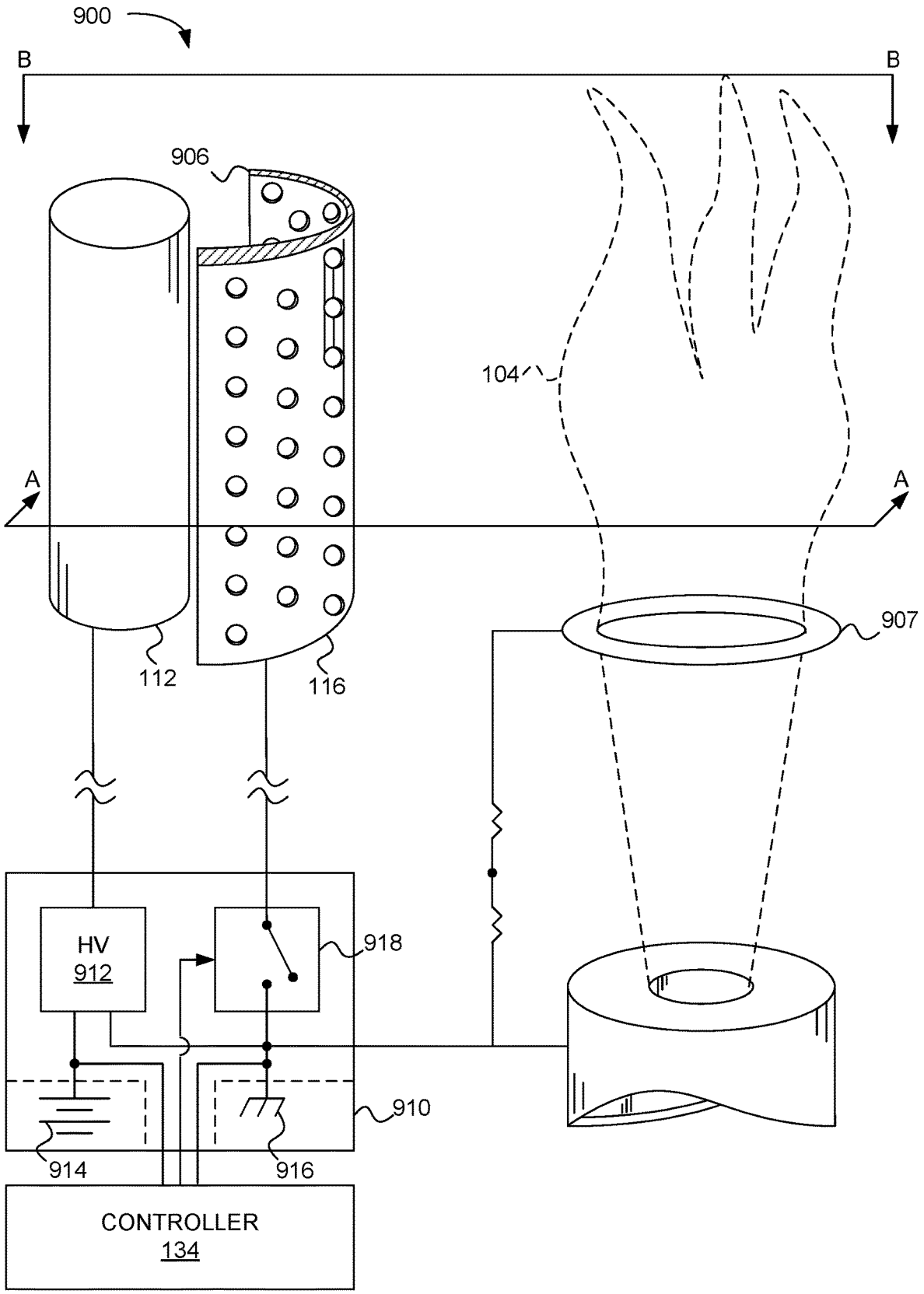
FIG. 9 is a diagram of a combustion system configured to receive electrical energy from a switched electrode system including a grid electrode, according to an embodiment.

FIG. 9 is a diagram of a combustion system configured to receive electrical energy from a switching electrode system 900 including a grid electrode 116, according to an embodiment. The switching electrode system 900 is configured to apply electrical energy to a combustion reaction 104 such as a flame. A first electrode assembly 112 is configured to carry a first voltage. A grid electrode 116 is configured to be selectably switched to ground or to another shield voltage. When not switched to ground or another shield voltage, the grid electrode 116 is configured to electrically float to a voltage substantially the same as the first voltage or to a voltage between the first voltage and ground or shield voltage. The grid electrode 116 is disposed between the first electrode assembly 112 and a combustion reaction 104. The grid electrode 116 is configured to cause the combustion reaction 104 to receive electrical energy from the first electrode assembly 112 when the grid electrode 116 is allowed to electrically float. The grid electrode 116 is configured to shield the combustion reaction 104 from the voltage carried by the first electrode assembly 112 when the grid electrode 116 is switched to ground (or another shield voltage).

In some embodiments, the grid electrode 116 can substantially surround the first electrode assembly 112, either volumetrically or in a plane. In some embodiments, the first voltage can be dynamic. For example a slow to relatively fast rising voltage can be placed on the first electrode assembly 112, and the shield electrode 906 can shield the dynamic voltage from the combustion reaction 104 for some delay. Then, after a delay or after a selected voltage is sensed on the first electrode assembly 112, the shield electrode 906 can be decoupled from ground or shield voltage. According to an embodiment, this approach can provide a faster rise time in a voltage pulse applied to the combustion reaction 104 than what could be accomplished by pulsing the first electrode assembly 112 alone. Similarly, the shield electrode 906 can be switched to ground or shield voltage simultaneously with (or slightly before or after) removing or decreasing the voltage placed on the first electrode assembly 112. Reducing the voltage placed on the first electrode assembly 112 combined with switching the shield electrode 906 to ground or shield voltage can provide a faster falling edge to the combustion reaction 104.

The shield electrode can work in combination with either/both positive and/or negative voltages applied to the first electrode assembly 112. First electrode voltage magnitudes between 10 kilovolts and 40 kilovolts were found to be effectively switched (shielded/unshielded from a propane flame) with the shield electrode 906. The effectiveness was determined by observing visible flame 104 behavior when the first electrode assembly 112 was configured as a field electrode operating to deflect a charged flame. The effectiveness was also determined by measuring current flow between a probe 907 and ground. With the shield electrode 906 decoupled from ground, current flow from the probe 907 was substantially equal to current flow (at a similar first voltage) caused by a first electrode assembly 112. When the shield electrode 906 was put into continuity with ground, current flow from the probe 907 fell to substantially zero.

According to an embodiment, a controller 134 can be operatively coupled to at least the grid electrode 116. The controller 134 can be configured to switch the grid electrode 116 to cause the switching electrode system 900 to apply a time-varying electrical energy to the combustion reaction 104. Similarly, the controller 134 can be configured to cause fast removal of electrical energy from the combustion reaction 104 responsive to a safety fault or as a fail-safe device used in conjunction with burner maintenance, for example.

A voltage circuit 910 can be operatively coupled between the controller 134 and at least the grid electrode 116. The voltage circuit 910 can be configured to apply the first voltage to at least a circuit including the first electrode assembly 112 and to selectably switch the grid electrode 116 to ground responsive to control from the controller 134. The first voltage can be positive, negative, time-varying unipolar, or time-varying bipolar, for example.

The voltage circuit 910 can include separable modules configured respectively to apply the first voltage to at least a circuit including the first electrode assembly 112 and to selectably switch the grid electrode 116 to ground. Additionally or alternatively, the voltage circuit 910 can include a single circuit including discrete and/or integrated electrical devices. The voltage circuit 910 can include a high voltage-voltage conversion circuit 912 configured to amplify, multiply, or charge pump a source voltage 914 substantially to the first voltage. The voltage circuit 910 can include a power ground 916. The voltage circuit 910 can include a modulatable switch 918 operatively coupled between a power ground 916 and the grid electrode 116.

According to various embodiments, the modulatable switch 918 can include a relay, reed switch, a mercury switch, a magnetic switch, a tube switch, a semiconductor switch, and/or an optical switch. The modulatable switch 918 can include an IGBT device, a FET device, and/or a MOSFET device. The modulatable switch 918 can include an integrated circuit. The modulatable switch 918 can include discrete parts. The modulatable switch 918 can include a combination of one or more devices thereof.

The grid electrode 116 can include a conductive mesh or a punched or drilled conductive sheet. For example, the grid electrode 116 can be formed from approximately ⅛ inch anodized aluminum including approximately ¼ inch drilled holes. Additionally or alternatively, the grid electrode 116 can include a plurality of wires.

The switched electrode system 900 can be configured such that current flow is from the grid electrode 116 to the first electrode assembly 112 when the grid electrode 116 is switched to continuity with ground. Additionally or alternatively, the current flow can be from the first electrode assembly 112 to the grid electrode 116 when the grid electrode 116 is switched to continuity with ground.

According to an embodiment, the switched electrode system 900 can be configured such that current flow is from the combustion reaction 104 to the first electrode assembly 112 when the grid electrode 116 is allowed to electrically float. Additionally or alternatively, the current flow can be from the first electrode assembly 112 to the combustion reaction 104 when the grid electrode 116 is allowed to electrically float.

Figure 10:
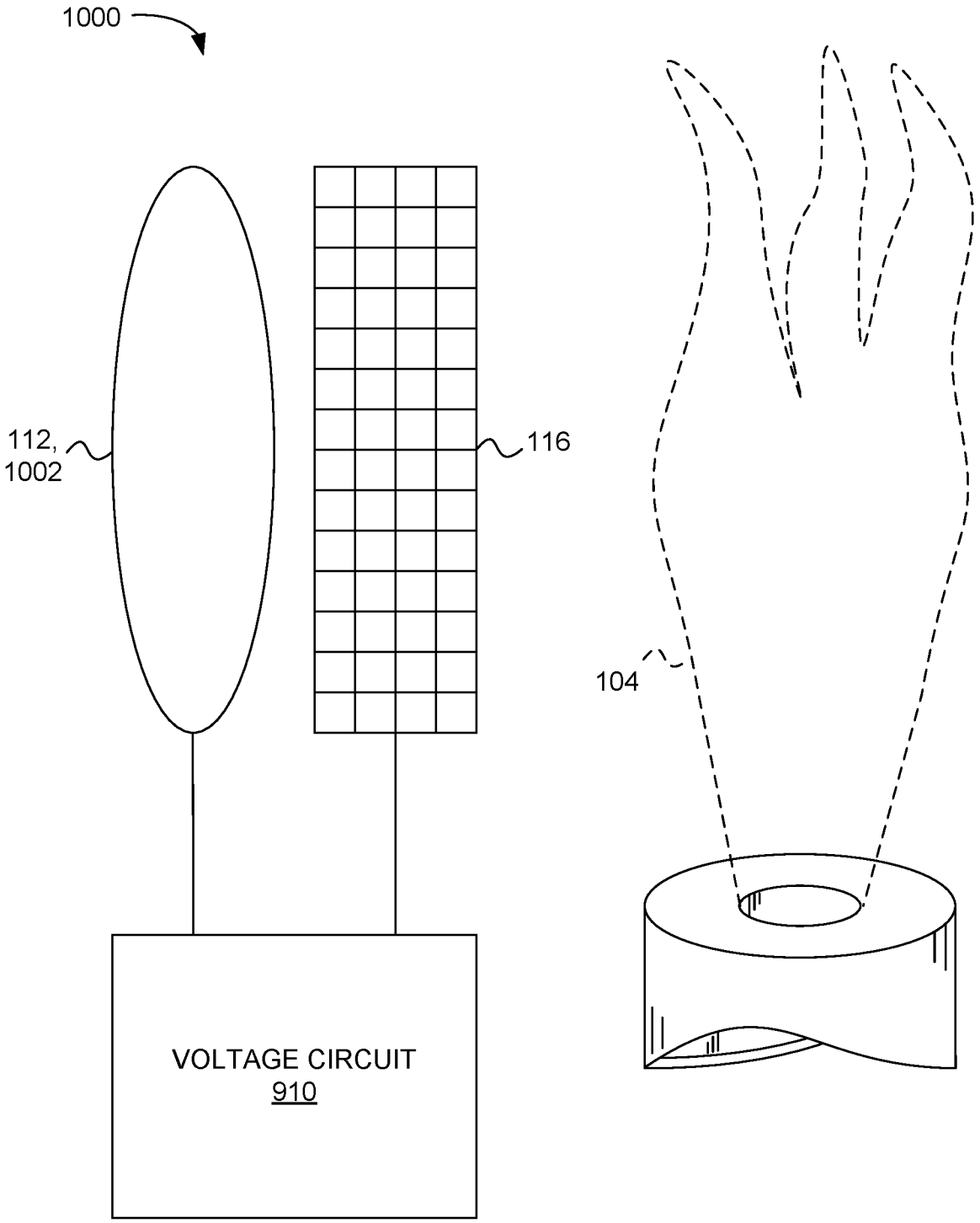
FIG. 10 is a simplified diagram of a combustion system including a switched electrode system with a smooth (non-ion ejecting) electrode configured to be switched by a grid electrode, according to an embodiment.

According to an embodiment, the electrical energy received by the combustion reaction 104 can include an electrical field. FIG. 10 is a representation of a combustion system 1000 including a smooth electrode 1002 and a grid electrode 116, according to an embodiment. When the first electrode assembly 112 includes a smooth electrode 1002, the electrical energy applied to the combustion reaction 104 by the switching electrode system can include or consist essentially of an electrical field.

Figure 11:
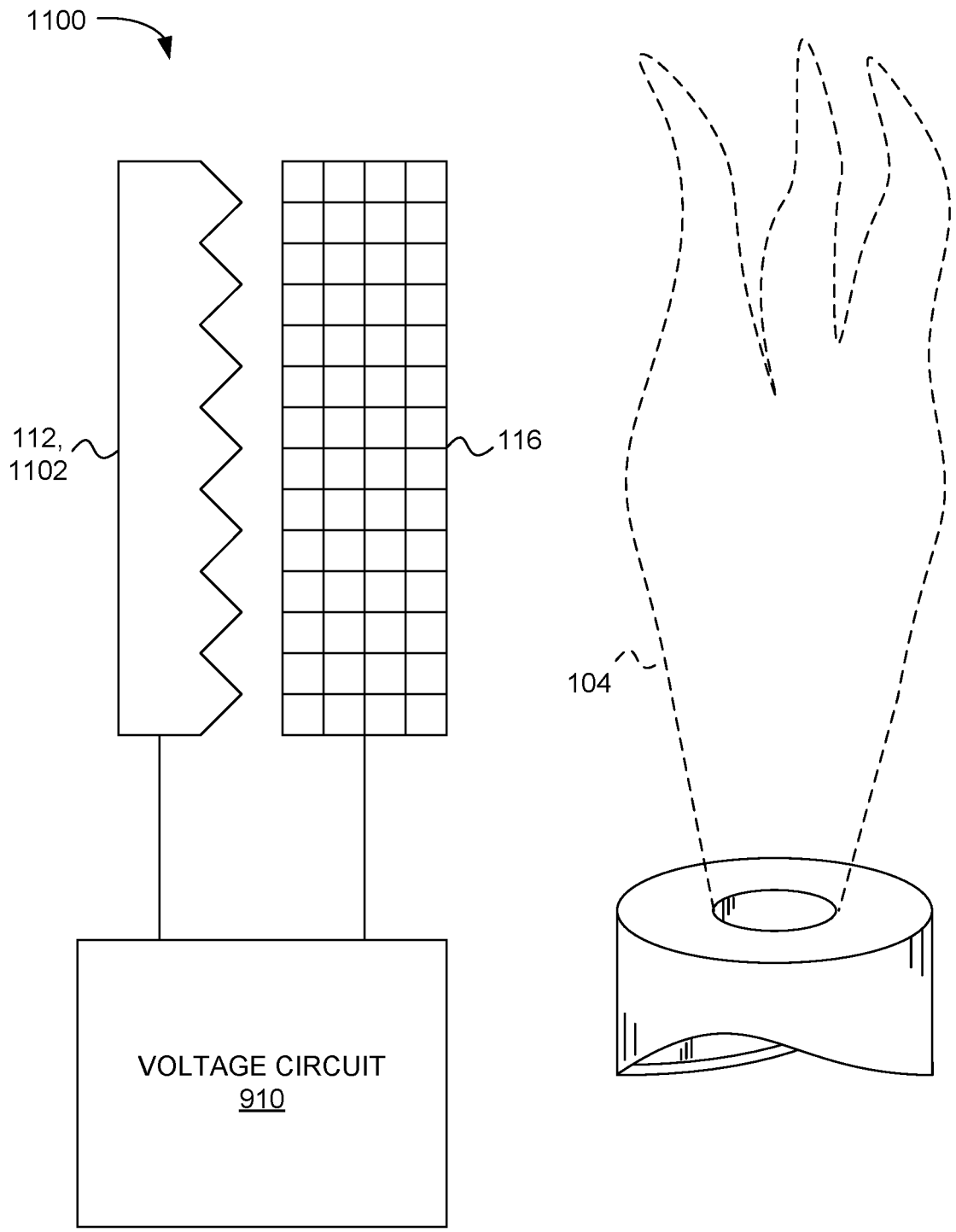
FIG. 11 is a simplified diagram of a combustion system including a switched electrode system with a sharp (corona) electrode configured to be switched by a grid electrode, according to an embodiment.

FIG. 11 is a diagram of a combustion system 1100 wherein the first electrode assembly 112 includes a sharp electrode 1102. The sharp electrode 1102 can include one or more sharp features that eject ions when a sufficiently high voltage is applied to the sharp electrode 1102. In such an embodiment, the sharp electrode 1102 can alternatively be referred to as a corona electrode. The grid electrode 116 can alternately permit or interrupt ion flow from the sharp electrode 1102. For example, charge can flow from the sharp electrode 1102 to the combustion reaction 104 when the grid electrode 116 is decoupled from ground (or other shield voltage). If the sharp electrode 1102 is raised to a sufficiently high negative voltage, the charge can flow from the combustion reaction to the sharp electrode when the grid electrode is decoupled from ground. When the voltage circuit 110 couples the grid electrode 116 to ground or other shield voltage, current flow between the sharp electrode 1102 and the combustion reaction 104 can substantially stop.

The sharp electrode 1102 can include a point ion emitter, a serrated ion emitter, and/or a curvilinear ion emitter (such as a corona wire, for example).

Figure 12A:
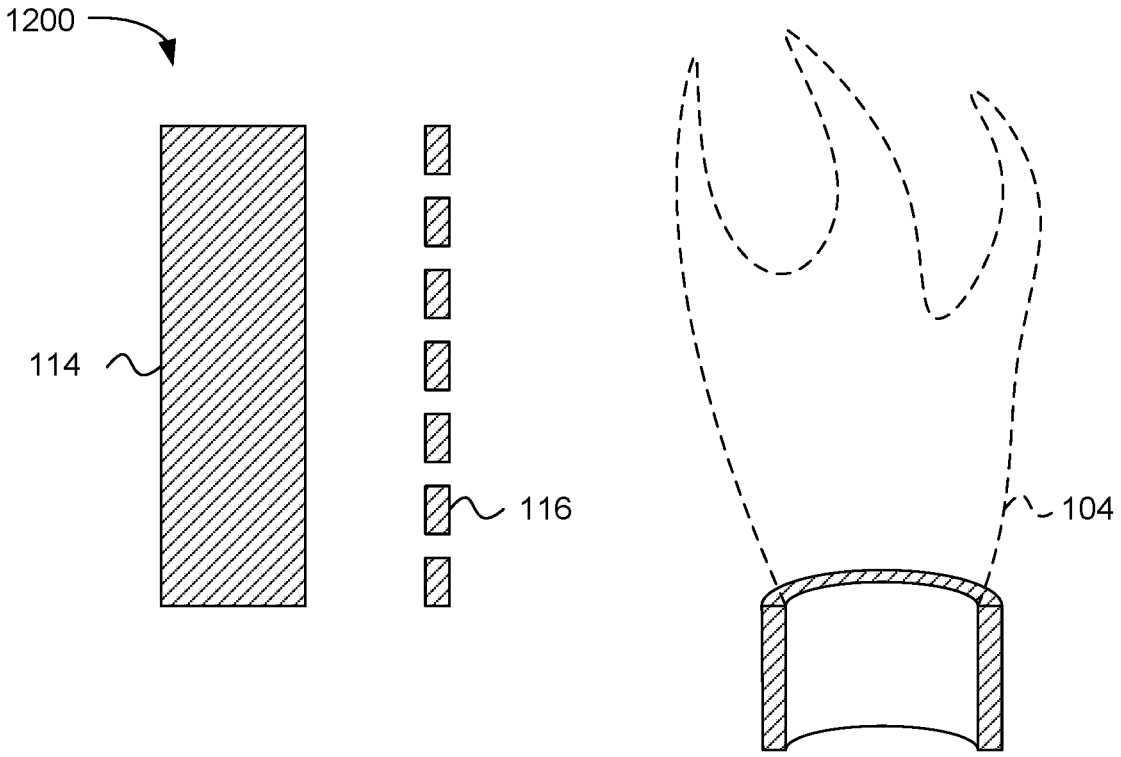
FIG. 12A is a side sectional view of the electrodes and combustion reaction of FIG. 9, according to an embodiment.

FIG. 12A is a side sectional view 1200 of the electrodes 114, 116 and combustion reaction 104 of FIG. 9, according to an embodiment.

Figure 12B:
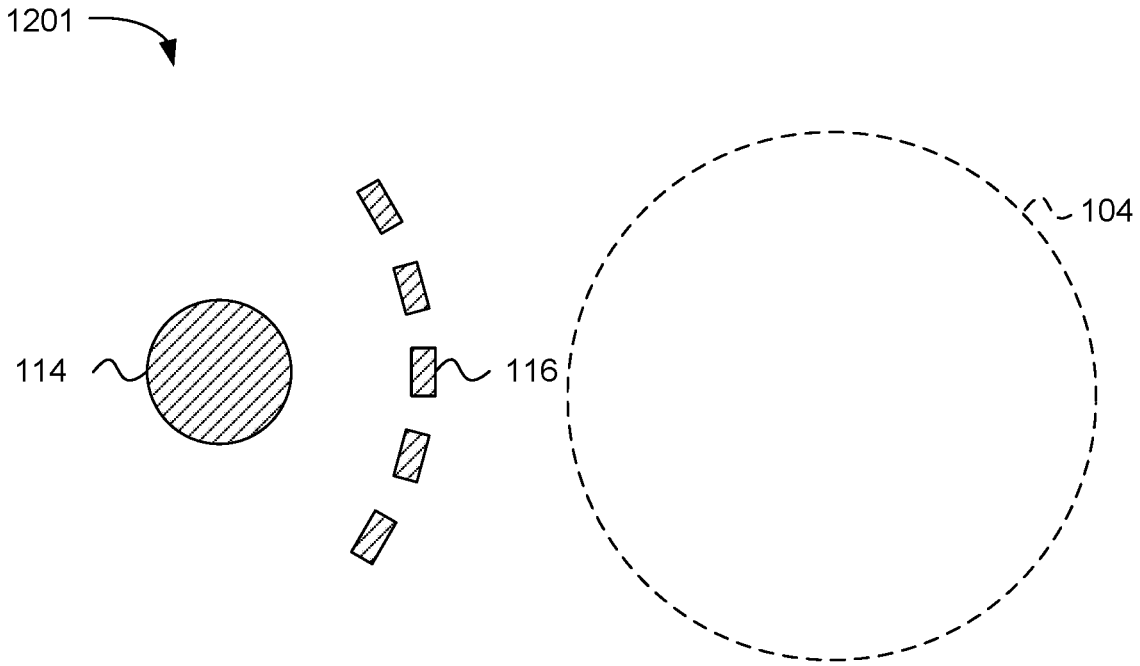
FIG. 12B is a cross sectional view of the electrodes and combustion reaction of FIG. 9, according to an embodiment.

FIG. 12B is a cross sectional view 1201 showing a top view of the electrodes 114, 116 and combustion reaction 104 of FIG. 9, according to an embodiment.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system configured to apply electrical energy to a combustion reaction, comprising:

a flame holder disposed in a combustion volume defined at least partially by a combustion volume wall, and configured to hold a combustion reaction;

a power supply including a first output node configured to carry a first voltage;

a first electrode assembly including a first electrode operatively coupled to the first output node of the power supply and configured to carry the first voltage;

a grid electrode disposed between the first electrode assembly and the flame holder; and an electrical switch operatively coupled to the grid electrode, the electrical switch being configured to selectably couple and decouple the grid electrode to a shield voltage;

wherein the shield voltage is selected to prevent the combustion reaction from receiving electrical energy from the first electrode assembly.

2. The combustion system configured to apply electrical energy to a combustion reaction of claim 1, wherein the shield voltage is different than the first voltage.

3. The combustion system configured to apply electrical energy to a combustion reaction of claim 2, wherein the shield voltage is voltage ground.

4. The combustion system configured to apply electrical energy to a combustion reaction of claim 1, wherein the first electrode assembly includes the first electrode and a counter electrode;

wherein the first electrode and counter electrode are operatively coupled to respective first and second nodes of the power supply; and wherein the power supply is configured to output respective voltages on the first and second nodes selected to cause an ionic wind to stream from the first electrode toward the grid electrode.

5. The combustion system configured to apply electrical energy to a combustion reaction of claim 1, wherein the first electrode assembly includes the first electrode and a counter electrode; and wherein the first electrode is a corona electrode.

6. The combustion system configured to apply electrical energy to a combustion reaction of claim 5, wherein the power supply is configured to output a voltage on the first node operatively coupled to the first electrode at or above a corona inception voltage.

7. The combustion system configured to apply electrical energy to a combustion reaction of claim 1, wherein the electrical switch is further configured to selectively decouple the grid electrode from the shield voltage.

8. The combustion system configured to apply electrical energy to a combustion reaction of claim 7, wherein the power supply is configured to drive a grid electrode electrical node to cause the first electrode assembly to raise the grid electrode to an equilibrium electrical potential substantially equal to a local voltage corresponding to an electric field formed between the first electrode assembly and the combustion reaction when the grid electrode is decoupled from the shield voltage.

9. The combustion system configured to apply electrical energy to a combustion reaction of claim 7, wherein the grid electrode is configured to electrically float when the grid electrode is decoupled from the shield voltage.

10. The combustion system configured to apply electrical energy to a combustion reaction of claim 1, wherein the electrical switch is further configured to selectively decouple the grid electrode from the shield voltage and couple the grid electrode to a passing voltage node of the power supply configured to carry a passing voltage selected to allow the first electrode assembly to apply electrical energy to the combustion reaction.

11. The combustion system configured to apply electrical energy to a combustion reaction of claim 10, wherein the power supply is configured to output a variable passing voltage on the passing voltage node, the variable passing voltage being selected to cause the first electrode assembly to apply electrical energy to the combustion reaction proportional to the variable passing voltage.

12. The combustion system configured to apply electrical energy to a combustion reaction of claim 1, wherein the electrical switch comprises an insulated gate bipolar transistor (IGBT).

13. The combustion system configured to apply electrical energy to a combustion reaction of claim 1, wherein the electrical switch is part of the power supply.

14. The combustion system configured to apply electrical energy to a combustion reaction of claim 1, further comprising a controller configured to control the electrical switch.

15. The combustion system configured to apply electrical energy to a combustion reaction of claim 14, wherein the controller is part of the power supply.

16. The combustion system configured to apply electrical energy to a combustion reaction of claim 14, wherein the controller is separate from the power supply.

17. The combustion system configured to apply electrical energy to a combustion reaction of claim 14, wherein the controller is configured to control the electrical switch to cause the first electrode assembly to apply electrical energy to the combustion reaction corresponding to an electric field waveform having fast rising edges.

18. The combustion system configured to apply electrical energy to a combustion reaction of claim 14, wherein the controller is configured to control the electrical switch to cause the first electrode assembly to apply electrical energy to the combustion reaction corresponding to an electric field waveform having fast falling edges.

19. The combustion system configured to apply electrical energy to a combustion reaction of claim 14, wherein the controller is configured to control the electrical switch to cause the first electrode assembly to apply electrical charges to the combustion reaction according to a waveform having fast rising edges.

20. The combustion system configured to apply electrical energy to a combustion reaction of claim 14, wherein the controller is configured to control the electrical switch to cause the first electrode assembly to apply electrical charges to the combustion reaction corresponding to a waveform having fast falling edges.

21. The combustion system configured to apply electrical energy to a combustion reaction of claim 1, wherein the grid electrode comprises a cylindrical surface.

22. The combustion system configured to apply electrical energy to a combustion reaction of claim 1, wherein the grid electrode comprises a metal screen.

23. The combustion system configured to apply electrical energy to a combustion reaction of claim 1, wherein the grid electrode comprises a metal screen having a mesh size of about 6 millimeters square.

24. The combustion system configured to apply electrical energy to a combustion reaction of claim 1, wherein the grid electrode comprises stainless steel hardware cloth.

* * * * *